US007809313B2

(12) United States Patent
Kitaoka

(10) Patent No.: US 7,809,313 B2
(45) Date of Patent: Oct. 5, 2010

(54) TONER BOTTLE UNIT AND IMAGE FORMING APPARATUS

(75) Inventor: Satoshi Kitaoka, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 150 days.

(21) Appl. No.: 11/956,852

(22) Filed: Dec. 14, 2007

(65) Prior Publication Data

US 2008/0279593 A1 Nov. 13, 2008

(30) Foreign Application Priority Data

Dec. 15, 2006 (JP) ..... 2006-339028

(51) Int. Cl.
*G03G 15/08* (2006.01)

(52) U.S. Cl. ..... 399/258; 399/262

(58) Field of Classification Search ..... 399/262, 399/258, 120, 119

See application file for complete search history.

(56) References Cited

U.S. PATENT DOCUMENTS

| | | | | |
|---|---|---|---|---|
| 6,097,903 | A * | 8/2000 | Yahata et al. | 399/262 X |
| 6,785,497 | B1 * | 8/2004 | Hasebe | 399/258 X |
| 2002/0164179 | A1 * | 11/2002 | Hosokawa | 399/258 |
| 2003/0138273 | A1 * | 7/2003 | Ichikawa et al. | 399/262 |
| 2004/0131389 | A1 * | 7/2004 | Tazawa et al. | 399/258 |
| 2007/0258735 | A1 * | 11/2007 | Ban et al. | 399/258 |
| 2009/0110429 | A1 | 4/2009 | Kitaoka | |

FOREIGN PATENT DOCUMENTS

| | | | |
|---|---|---|---|
| JP | 10-073987 | A * | 3/1998 |
| JP | 2000-250307 | | 9/2000 |
| JP | 2002-268357 | | 9/2002 |
| JP | 2002-341648 | | 11/2002 |
| JP | 2003-57930 | | 2/2003 |
| JP | 3492856 (B2) | | 11/2003 |
| JP | 2004-333760 | | 11/2004 |
| JP | 2005-292300 | | 10/2005 |
| JP | 2006-126570 | | 5/2006 |
| JP | 2006-259228 | | 9/2006 |

* cited by examiner

*Primary Examiner*—Sophia S Chen
(74) *Attorney, Agent, or Firm*—Oblon, Spivak, McClelland, Maier & Neustadt, L.L.P.

(57) ABSTRACT

A toner bottle unit detachable to an image forming apparatus includes an opening/closing device for making an opening of a toner bottle by removing a cap from the opening and closing the opening by attaching the cap. An opening/closing operation device is provided to swing from an open position, in which the opening/closing device makes the opening, to close position, in which the opening/closing device closes the opening. The opening/closing device is operated to make the opening in conjunction with swinging movement of the opening/closing operation device from the close position to the open position, and closes the opening in conjunction with the swinging movement of the opening/closing operation device from the open position to the close position. The opening/closing operation device is swung between the open and close positions substantially around the central axis.

9 Claims, 34 Drawing Sheets

--Related Art--

--Related Art--

--Related Art--

--Related Art--

--Related Art--

--Related Art--

--Related Art--

--Related Art--

TONER BOTTLE UNIT AND IMAGE FORMING APPARATUS

CROSS REFERENCE TO RELATED APPLICATION

This application claims priority under 35 USC §119 to Japanese Patent Application No. 2006-339028, filed on Dec. 15, 2006, the entire contents of which are herein incorporated by reference.

BACKGROUND OF THE INVENTION

1. Field of the Invention

The present invention relates to a toner bottle unit that replenishes toner to a developing device included in an image forming apparatus, such as a printer, a facsimile, etc., and an image forming apparatus including the toner bottle unit.

2. Discussion of the Background Art

In an image forming apparatus that visualizes a latent image formed on a latent image bearer using two component developer stored in a developing device, toner in the developing device needs to be replenished as image formation proceeds.

According to a conventional image forming apparatus, a toner bottle is employed to store and replenish toner to a developing device when the toner is consumed. In such an apparatus, a used up toner bottle needs to be generally replaced with a new by a user whenever the toner in the toner bottle is used up.

According to a conventional replacement operation described in the Japanese Patent Registration No. 3492856, when a used up toner bottle is to be replaced with a new toner bottle, a cap of a toner ejection outlet previously detached from the toner bottle is attached to the toner ejection outlet when the toner bottle unit mounting the toner bottle is initially attached to a prescribed position of the image forming apparatus body as shown in FIG. 38. Specifically, an operation lever 81 is swung to a direction shown by an arrow (a) around a rotational axis of the operation lever 81 as a swinging center, and a cap opener 82 grasping the cap is moved to a direction as shown by an arrow (b) in conjunction with the swinging of the operation lever 81, and the cap is attached to the toner ejection outlet 84. Then, as shown in FIG. 39, the operation lever 81 is pulled in a direction as shown by an arrow (c), and the toner bottle unit 80 is withdrawn to a prescribed position outside the image forming apparatus. Then, the used up toner bottle is replaced with a new toner bottle at the prescribed position. When the replacement of the toner bottle 85 is completed, a tip of the operation lever 81 is pushed in a direction as shown by an arrow (d) in FIG. 40. The toner bottle unit 80 is then attached to a prescribed position of the image forming apparatus body. Then, as shown in FIG. 41, when the operation lever 81 is swung in a direction as shown by an arrow (e), the cap opener 82 grasping the cap 83 is withdrawn in a direction as shown by an arrow (f'), thereby the cap 83 is detached. In this way, toner in the toner bottle 85 can be ejected to the image forming apparatus body while the toner ejection outlet is open as shown in FIG. 38.

Further, it is conventionally known that toner is finally replenished to a developing device in an image forming apparatus body from a toner container included in a toner bottle unit. An opening is arranged on the toner container to engage with the developing device, so that the toner is replenished to the developing device through the opening. In the opening, a shutter for opening and closing the opening is provided to adjust an amount of toner supplied to the developing device from the toner container. For example, Japanese Patent Application Laid Open No. 2006-259228 discloses a plate like opening mechanism with a shutter hinge construction for opening and closing an opening of a toner containing section. The surface of the shutter contacts the edge of the opening and closes the opening by covering thereof. In this way, when a toner bottle is to be replaced and thus the toner bottle unit holding the toner bottle is withdrawn from the image forming apparatus body, the shutter closes the opening so that toner stored in the toner containing section does not leak from the opening. When the toner bottle unit is attached to the image forming apparatus body, the shutter opens opening, thereby the toner containing section is communicated with the developing device so that the toner can be supplied to the developing device from the toner containing section.

As shown in FIGS. 42 and 43, the toner bottle unit 80 of the Japanese Patent Registration No. 3492856 is attached to the image forming apparatus body by pushing one end of the operation lever 81 arranged almost on the longitudinal axis of the cylindrical toner bottle 85 toward the image forming apparatus. Thus, when the toner bottle unit 80 is attached to the image forming apparatus body, a direction of a pushing force applied to the operation lever 81 sometimes deviates from the axis of the toner bottle, for example, inclining downwardly from the axis in a direction (f) as shown by a two-doted line in FIG. 44. In such a situation, a component of the pushing force can be divided into horizontal and vertical directions as shown by arrows (g) and (h). Specifically, a force is applied to the end of the operation lever 81 not only in the axis direction but also in the vertical direction. A distance (I) between the rotary shaft 86 and the operation lever 81 is set to a prescribed level enabling a user to swing the operation lever 81 with a small power considering a moment of a force around the rotary shaft 86.

Accordingly, when only a slight power is applied in the vertical direction deviating from the shaft axis as shown by an arrow (f), the operation lever 81 is easily swung, and the cap-opening device 82 removes the cap 83 from the toner bottle 85 in conjunction therewith. As a result, toner scatters from the toner bottle 85 during the attachment of the toner bottle unit 80 to the image forming apparatus body as shown in FIG. 45.

In the image forming apparatus of the JPO2006-259228, toner adheres to the surface of the shutter as time elapses. Thus, when the shutter closes the opening, the toner adherence creates a gap at a contact portion between the flat surface of the shutter and the circumferential edge of the opening. Accordingly, when the toner bottle unit is attached and detached to and from the image forming apparatus body for the purpose of replacing the toner bottle, the toner remaining in the toner containing section leaks therefrom via the gap.

SUMMARY OF THE INVENTION

Accordingly, an object of the present invention is to improve such background arts technologies and provides a new and novel toner bottle unit. Such a new and novel toner bottle unit is detachable to an image forming apparatus and includes an opening/closing device that makes an opening of a toner bottle by removing a cap from the opening and closes the opening by attaching the cap thereto. An opening/closing operation device is provided to swing from an open position, in which the opening/closing device makes the opening, to close position, in which the opening/closing device closes the opening. The opening/closing device is operated to make the opening in conjunction with the movement of the opening/closing operation device from the close position to the open position, and closes the opening in conjunction with the movement of the opening/closing device from the open position to the close position. The opening/closing operation device is arranged at a rear end of the toner bottle unit in an attaching direction substantially on a central axis of the toner bottle. The toner bottle unit is installed into the image forming apparatus when pushed substantially along the central axis through the opening/closing operation device. The opening/closing operation device is swung between the open and close positions substantially around the central axis.

In another embodiment, a rotation inhibition device is provided to inhibit the rotation of the opening/closing operation device.

In yet another embodiment, the rotation inhibition device includes an engaging member arranged in the apparatus body, and an engaged member arranged on the opening/closing operation device to be engaged with the engaging member. The rotation of the opening/closing operation device is inhibited by the engagement of the engaging and engaged members.

In another embodiment, toner bottle unit includes a toner bottle for containing toner, a conveyance path-forming member for forming a conveyance path to convey the toner from the toner bottle, a cylindrical hole formed on a side wall of the conveyance path forming member, and a shutter member for fitting into the cylindrical hole while tightly contacting an inner wall of the cylindrical hole. The shutter member opens and closes the conveyance path by changing a position within the cylindrical hole upon receiving an external force.

In another embodiment, the shutter member includes a penetrating hole penetrating the shutter member in a direction perpendicular to its axis. The shutter member is displaced between a first position in which the penetrating hole is communicated with the conveyance path, and a second position in which the peripheral surface of the shutter other than the penetrating hole closes the conveyance path.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENT OF THE PRESENT INVENTION

Figure 2:
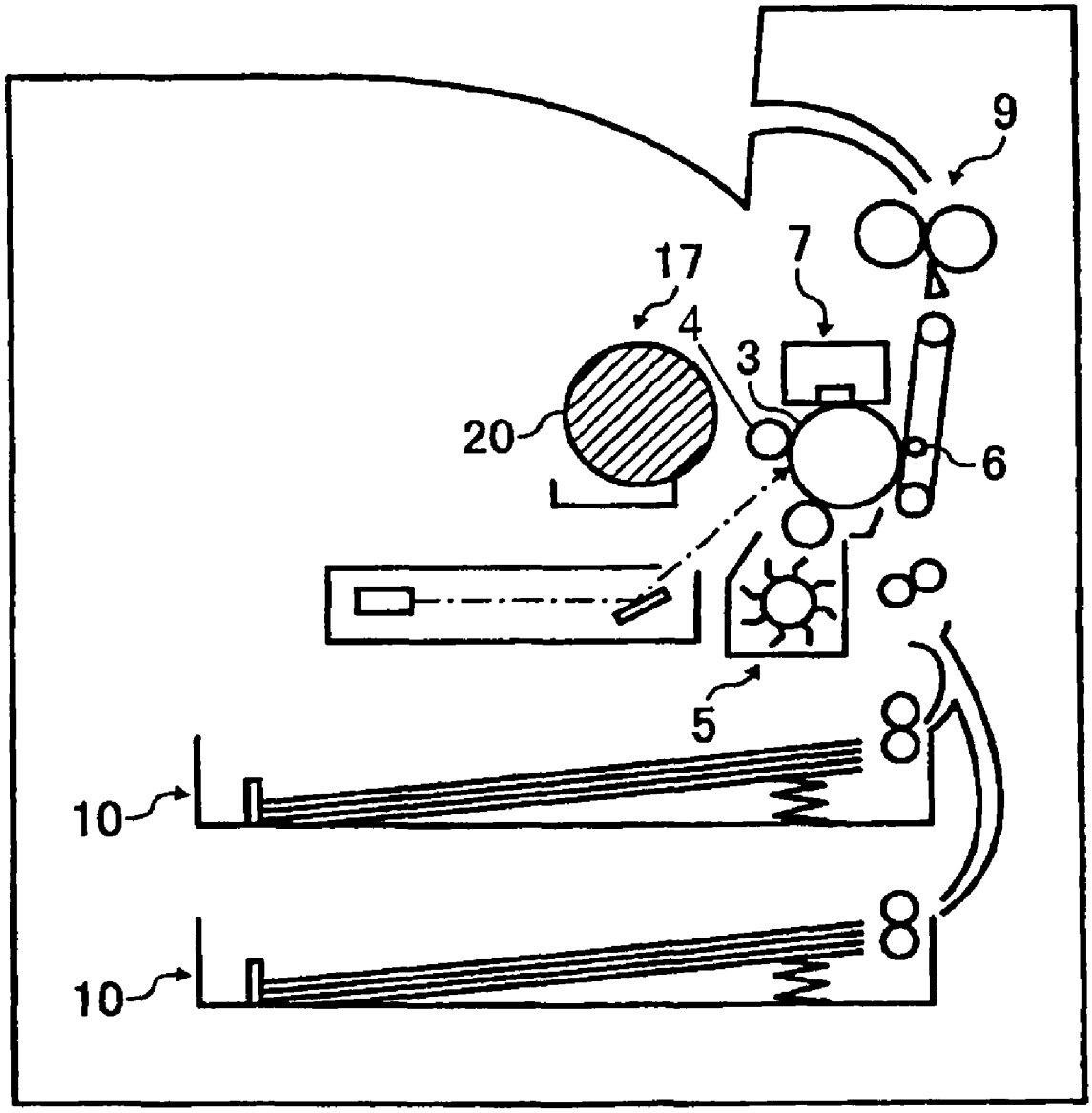
FIG. 2 is a schematic chart illustrating an exemplary printer according to one embodiment of the present invention.

Referring now to the drawing, wherein like reference numerals designate identical or corresponding parts throughout several views, in particular in FIG. 2, an exemplary printer according to one embodiment of the present invention is described. As shown, a drum type photoconductive member 3 is rotatavely provided in a printer. Around the photoconductive member 3, a charging device 4, a developing device 5, a transferring device 6, and a cleaning device 7 and similar devices are arranged. Above the photoconductive member 3, a fixing device 9 is arranged to fuse a toner image onto a transfer sheet on which the toner image is transferred by the transfer device 6. In the lower section of the printer, to accommodate and transfer sheets one by one toward the photoconductive member 3, a sheet feeding section 10 is arranged.

Figure 3A:
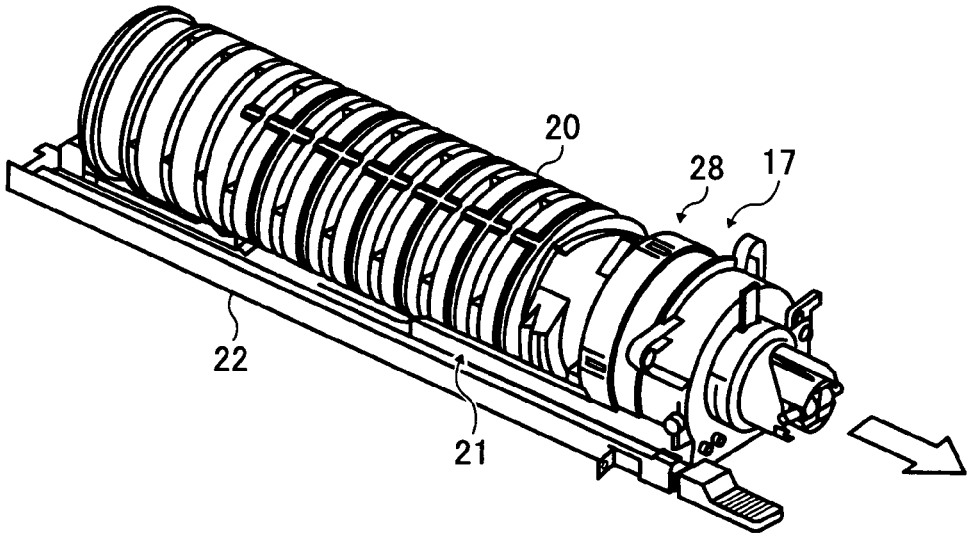
FIG. 3A is a perspective view illustrating an exemplary condition of the toner bottle unit withdrawn from the image forming apparatus body.
Figure 3B:
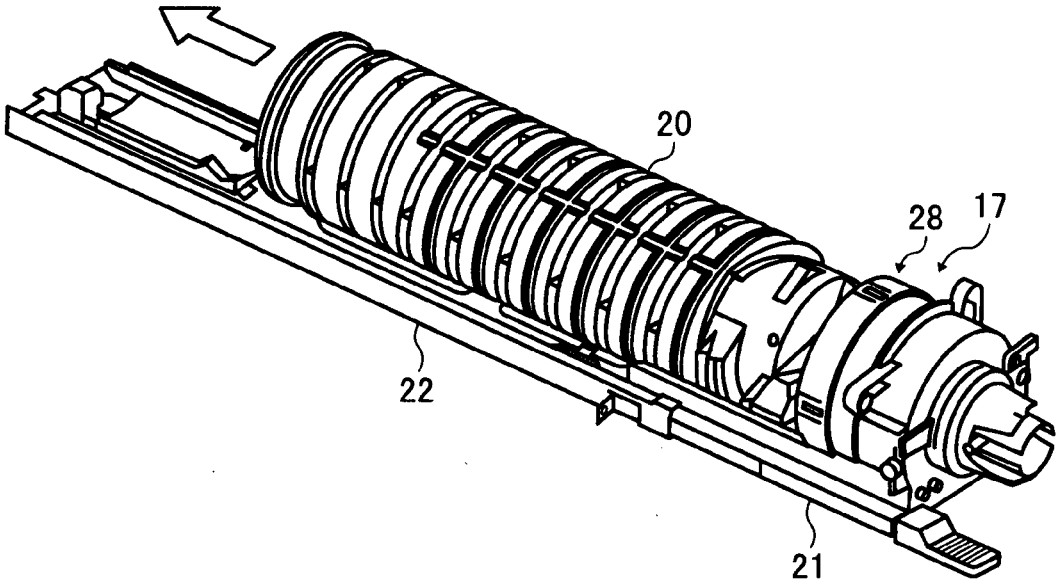
FIG. 3B is a perspective view illustrating an exemplary condition of the toner bottle unit installed into the image forming apparatus body.
Figure 4:
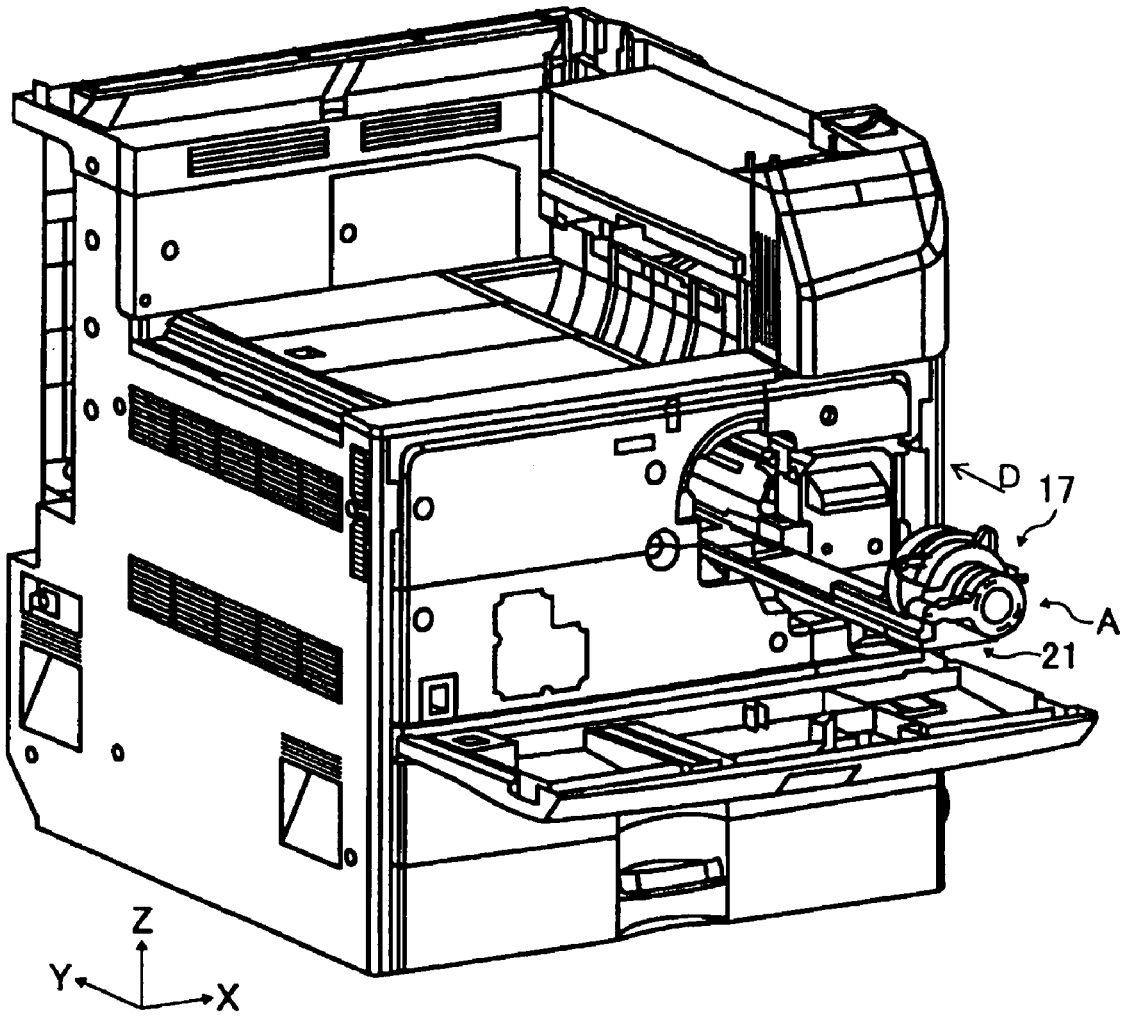
FIG. 4 is a perspective view of the toner bottle unit located at a bottle placement position when viewed from a front side of the image forming apparatus body.
Figure 5:
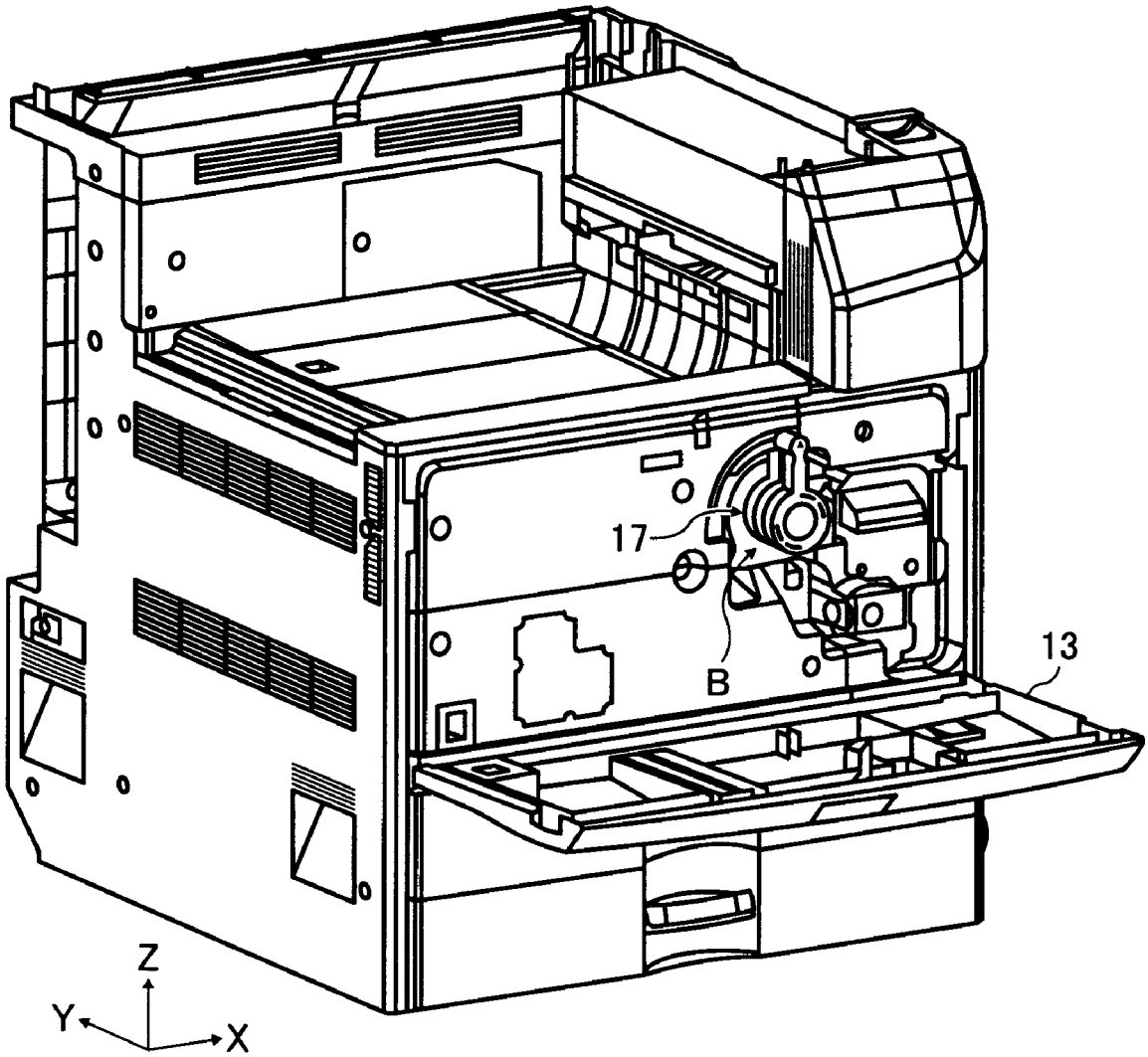
FIG. 5 is a perspective view of the toner bottle unit located at a toner replenishment position when viewed from a front side of the image forming apparatus body.
Figure 6:
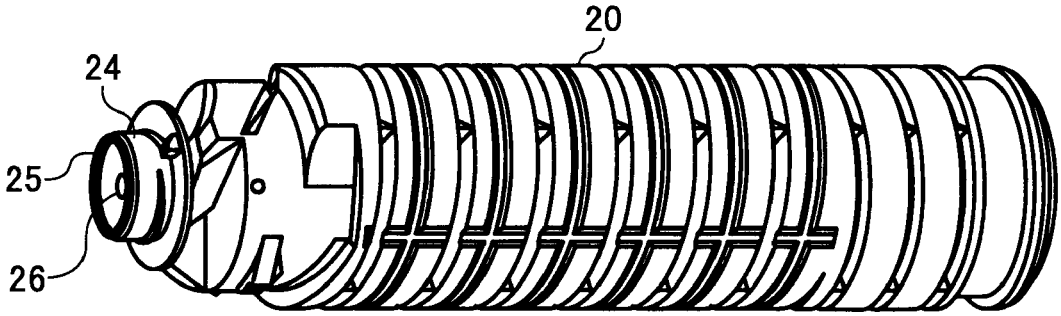
FIG. 6 is a perspective view of an exemplary toner bottle with its opening being sealed with a cap.
Figure 7:
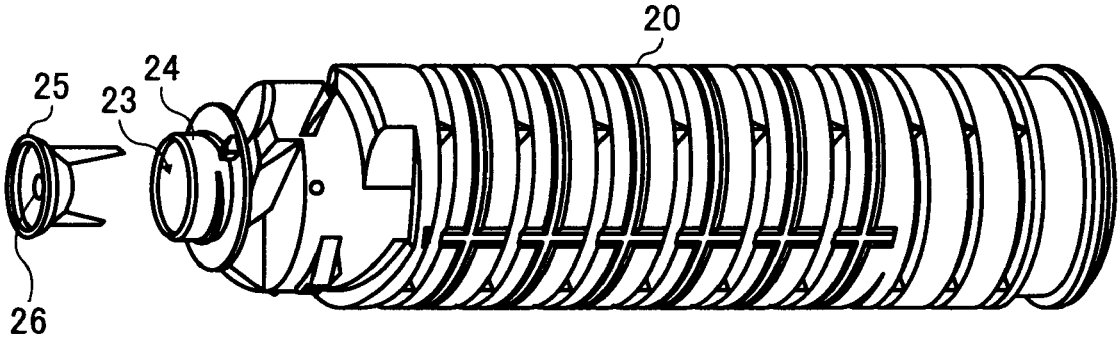
FIG. 7 is a perspective view of an exemplary toner bottle with its opening being open.
Figure 8A:
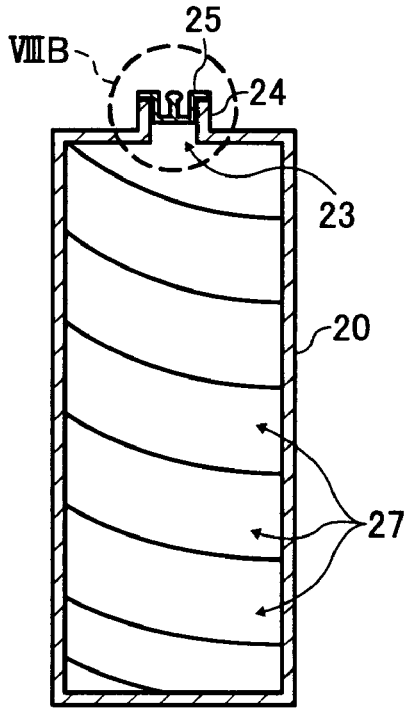
FIG. 8A is a schematic vertical cross sectional view of an exemplary toner bottle.
Figure 8B:
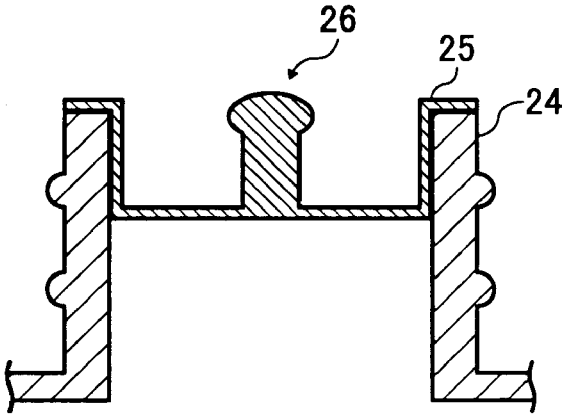
FIG. 8B is an enlarged view illustrating the vicinity of an opening of the toner bottle corresponding to VIIIB of FIG. 8A.

On the left side of the photoconductive member 3 and at an upper section of the front side of the printer, a toner bottle unit 17 is arranged as a developer replenishing device to replenish toner stored in a toner bottle 20 serving as a developer container to the developing device 5. As shown in FIG. 3A, the toner bottle unit 17 includes a bottle holder 21 serving as a container holding device for holding the toner bottle 20. The bottle holder 21 is arranged on a supporting member 22 slidably arranged in the apparatus body. Thus, the supporting member 22 takes a bottle placing position A for allowing placement of the toner bottle 20 when the toner bottle unit 17 is withdrawn from the printer body as shown in FIG. 4, and takes a toner replenishing position B where the toner bottle unit 17 is completely attached to the printer body as shown in FIG. 5 when the toner bottle unit 17 slides in the direction shown by an arrow (D) from the bottle placing position A shown in FIG. 3B. At the toner replenishing position B, toner can be replenished into the apparatus body via a hopper 16 described later from the toner bottle unit 17. The toner bottle unit 17 is preferably arranged inside a front cover 13 covering a printer front surface, and is withdrawn to the bottle placing position A while the front cover 13 is open.

With reference to FIGS. 6, 7, 8A and 8B, the toner bottle 20 is almost a cylindrical and has an opening 23 having a smaller diameter than that of the cylindrical section of the toner bottle. The opening 23 is arranged almost at a center of one end surface of the toner bottle 20. The opening 23 is formed on a tip of a collar 24 protruding from the surface. A cap 25 is arranged to seal the opening 23. A knob 26 is formed at a center of the cap 25. Further, a spiral guide groove 27 is formed on the inner circumferential surface of the cylindrical portion to guide toner contained in the toner bottle 20 toward the opening 23 as the toner bottle 20 rotates.

Figure 1:
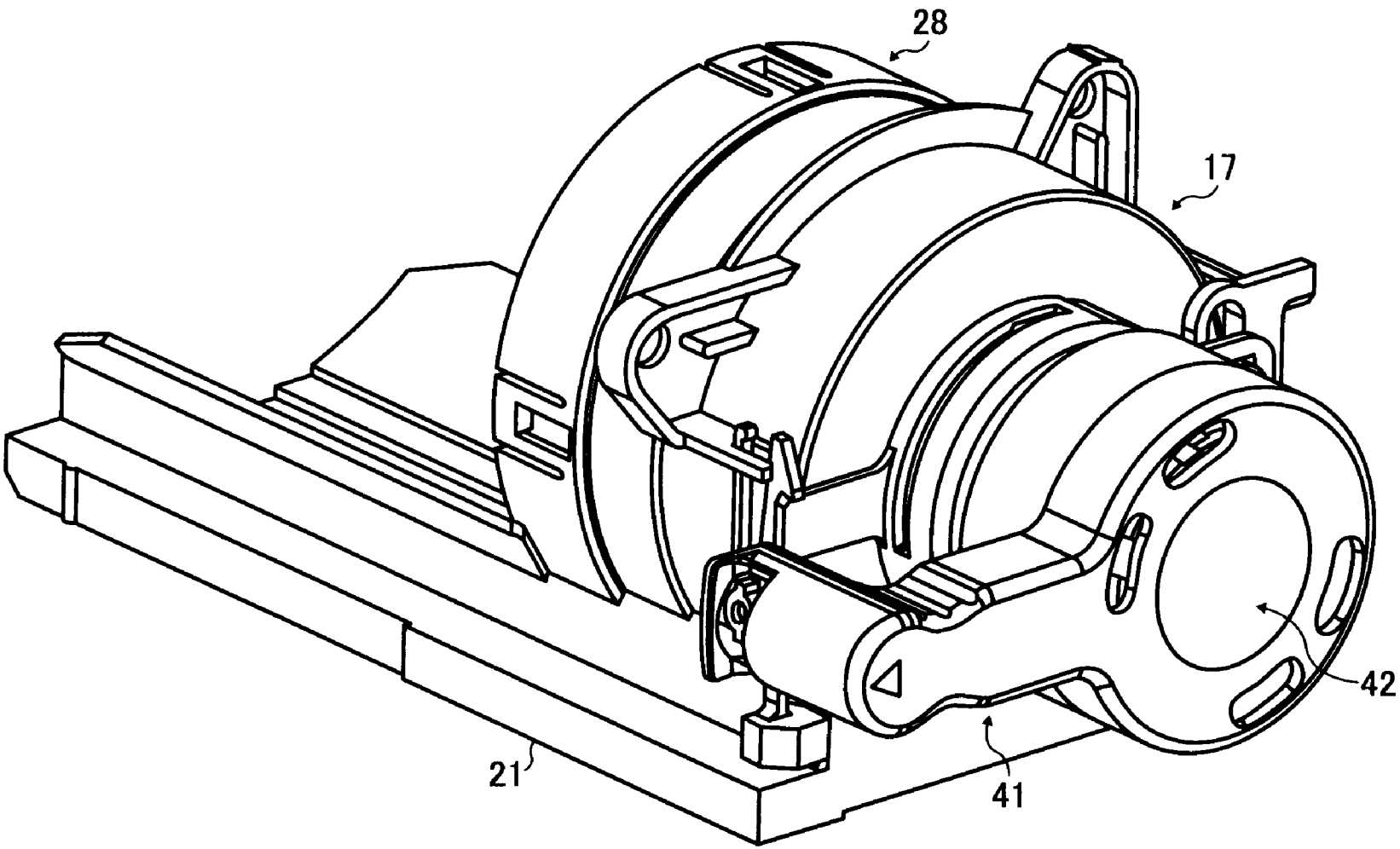
FIG. 1 is a schematic chart illustrating an exemplary toner bottle unit according to one embodiment of the present invention.

Now, an exemplary configuration of the toner bottle unit 17 is described more in detail. As mentioned above, the toner bottle unit 17 freely reciprocates the bottle placing position A, and the toner replenishing position B. A bottle holder 21 is capable of horizontally holding the toner bottle 20, and includes a bottle rotating drive device, not shown, for rotating and driving the toner bottle 20 held by the bottle holder 21, a collet chuck 30 for grasping the cap 25, and a cam device 40 for moving the collet chuck 30 back and forth. The cam device 40 is arranged inside the operation lever 41 as shown in FIG. 1, and is operated in conjunction with swinging of the operation lever 41. Then, by swinging the operation lever 41 to operate the cam device 40 and move the collet chuck 30 back and forth, the cap 25 of the toner bottle 20 is attached and detached.

Figure 9A:
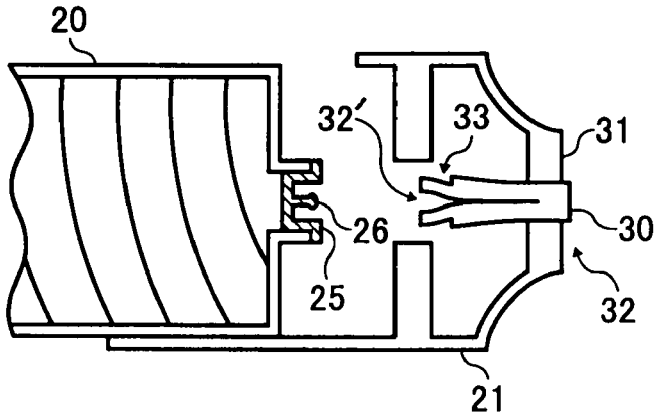
FIG. 9A is a schematic cross sectional view of the toner bottle before being set to a setting position of a bottle holder.

Now, an exemplary configuration and operation of a mechanism for removing the cap 25 from the toner bottle 20 when the cap seals the opening is described. As shown in FIG. 9A, the collet chuck 30 is supported by a hole 32 formed on a supporting wall 31 of the bottle holder 21. When the collet chuck is free as shown in FIG. 9A, the collet chuck is biased so that the grasping section 33 formed on the leading end of the collet chuck spreads. The grasping section 33 includes, at its tip, a plurality of clacks closable by an external force.

Figure 9B:
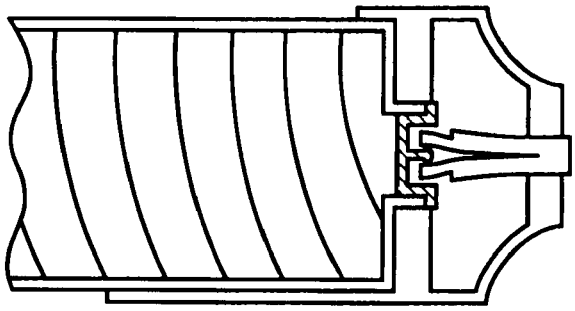
FIG. 9B is a schematic cross sectional view of the toner bottle when set to the setting position of a bottle holder.
Figure 10:
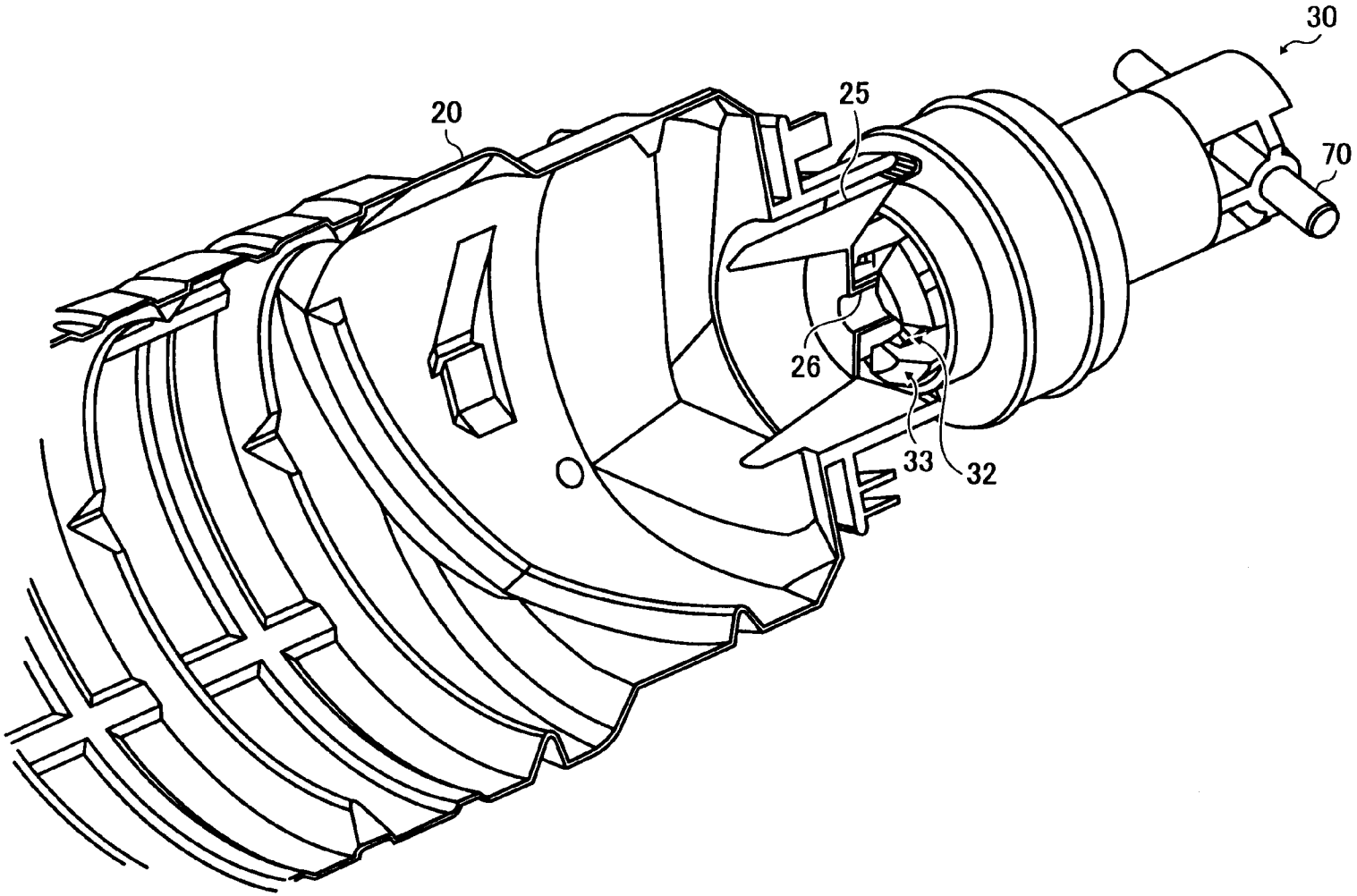
FIG. 10 is a perspective view of the toner bottle when set to the setting position on the bottle holder.
Figure 11:
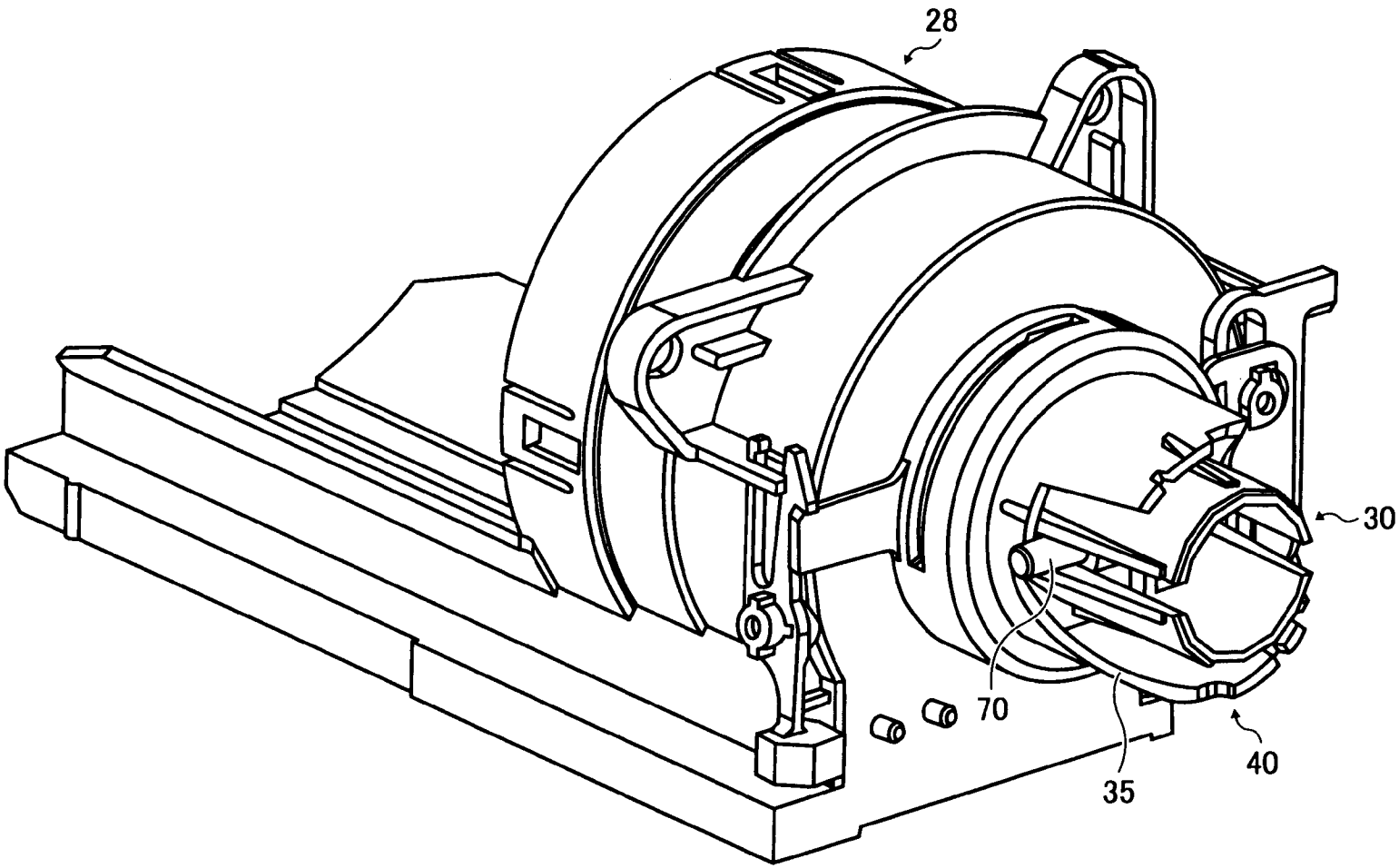
FIG. 11 is a perspective view of a cam device when the cap seals the opening of the toner bottle.
Figure 12:
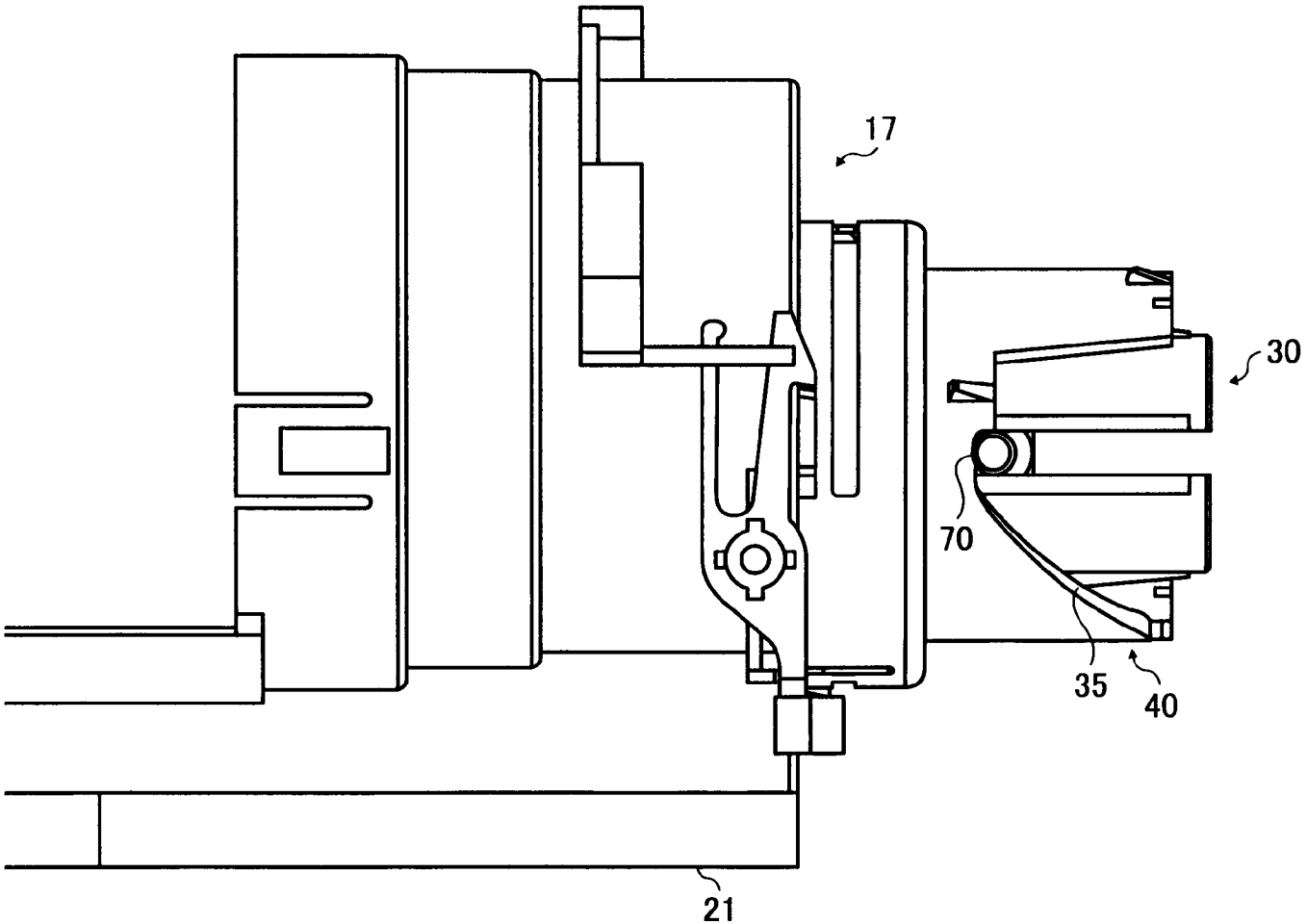
FIG. 12 is a front view of the cam device when the cap seals the opening of the toner bottle.

As shown in FIGS. 9B and 10, so that the knob 26 of the cap 25 can be grasped by the grasping section 33 of the collet chuck 30, the toner bottle 20 is set to the bottle holder 21 at a prescribed position to enable the knob 26 to be arranged opposing the hole 32'. When the grasping section 33 does not grasp the knob 26, the operation lever 41 is positioned at nine O'clock. Simultaneously, in the cam device 40 as shown in FIGS. 11 and 12, a moving member 70 (e.g. a cam follower) mounted on the collet chuck 30 sliding contacts the cam surface 35 and most approaches the toner bottle 20. The back and forth movement of the collet chuck 30 is created by movement of the moving member 70 along the cam surface 35.

Figure 13:
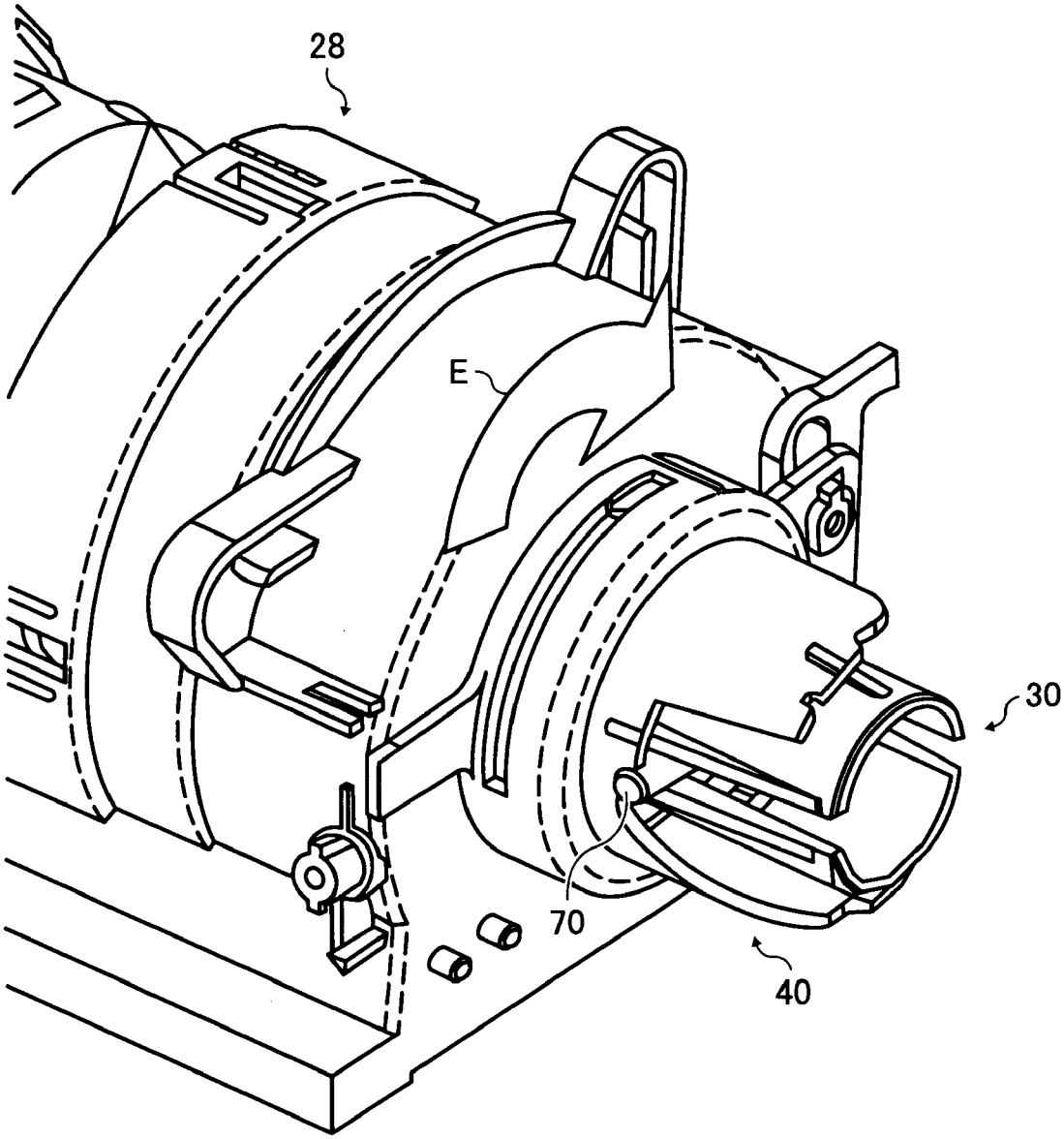
FIG. 13 illustrates an exemplary swinging operation of the operation lever when the cap is removed from the opening of the toner bottle.

When the cap 25 is to be removed from the opening 23 by means of the cam device 40, the operation lever 41 positioned at nine O'clock as shown in FIG. 13 is swung in a direction as shown by an arrow (E) up to twelve O'clock. In conjunction with the swinging, the collet chuck 30 is moved away from the toner bottle 20 with the grasping section 33 grasping the knob 26. Thus, the cap 25 is removed from the opening 23.

Figure 14:
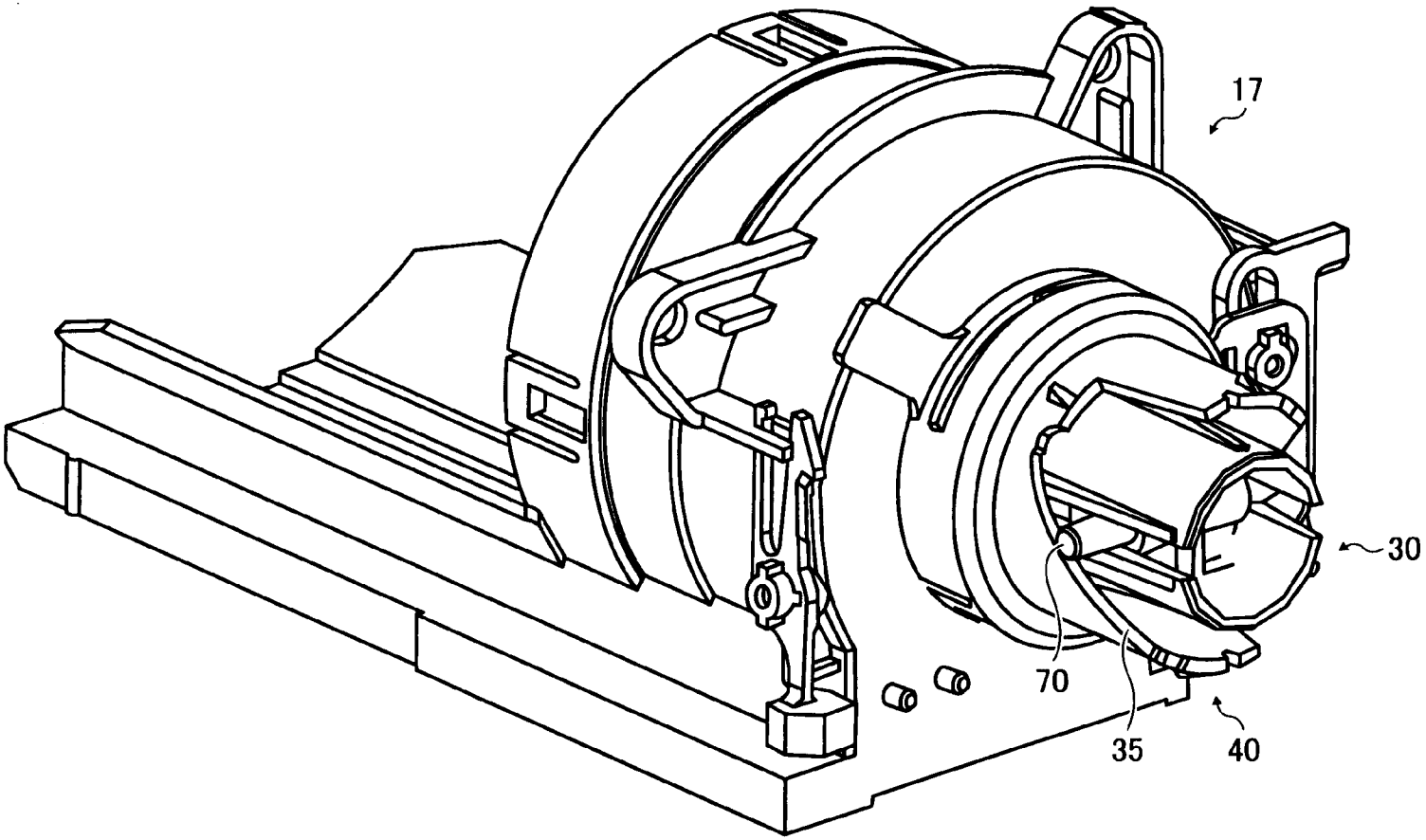
FIG. 14 illustrates a perspective view of the cam device when the operation lever is on the way to the twelve O'clock from nine O'clock.
Figure 15:
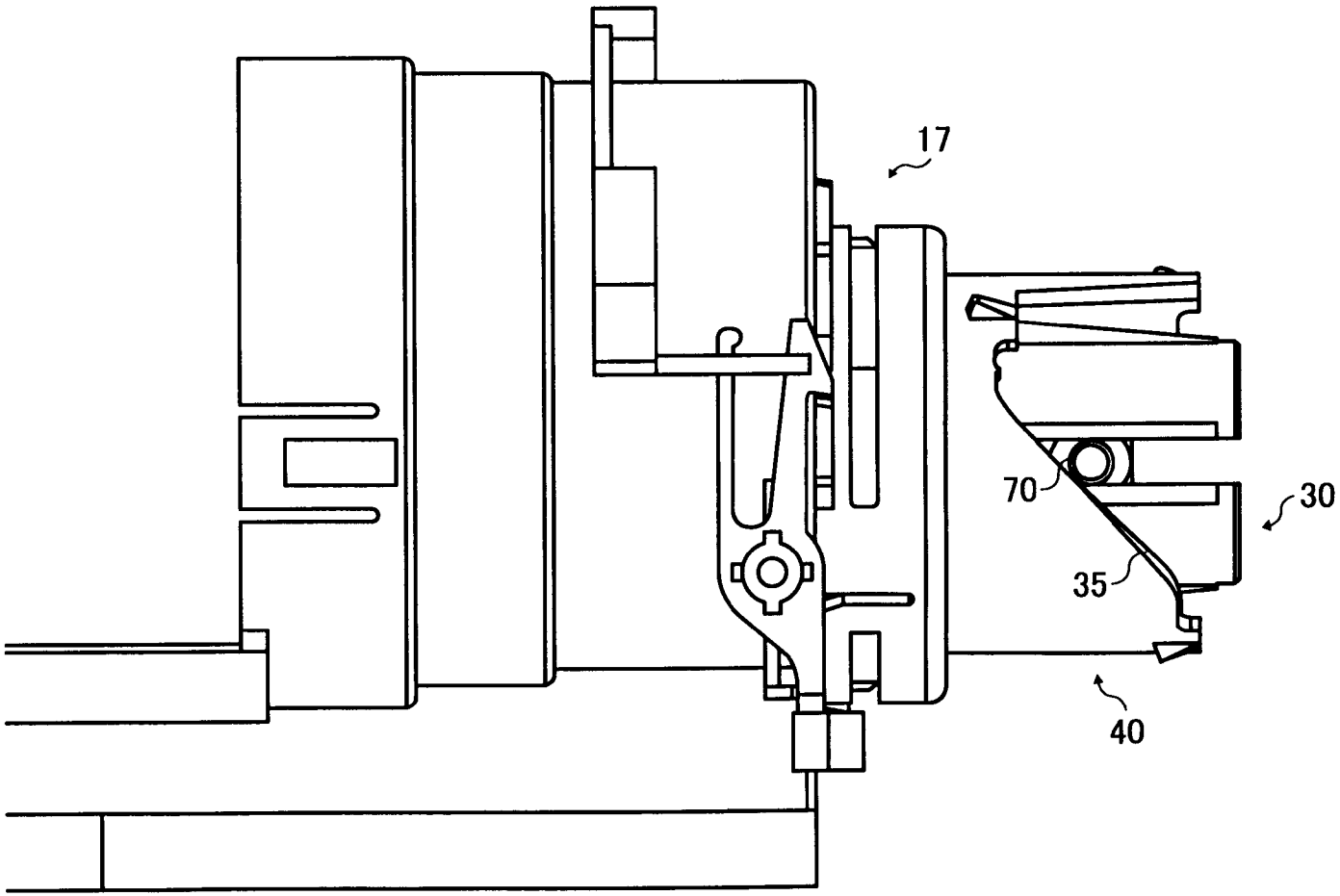
FIG. 15 illustrates a front view of the cam device when the operation lever is on the way to the twelve O'clock from nine O'clock.

As shown in FIGS. 14 and 15, since the body of the cam device 40 is enabled to move in conjunction with the swinging of the operation lever 41, and rotate in the same direction as the operation lever 41 swings, the body of the cam device 40 rotates as the operation lever 41 swings in the direction (E). Then, by rotation of the body of the cam device 40, the moving member 70 is distanced from the toner bottle 20 along the cam surface 35 as shown in FIGS. 14 and 15. Accordingly, the collet chuck also moves apart from the toner bottle 20. Thus, a large radius section of the collet chuck 30 is pressed by the inner surface of the hole 32, thereby the grasping section 33 is narrowed and grasps the knob 26.

Figure 9C:
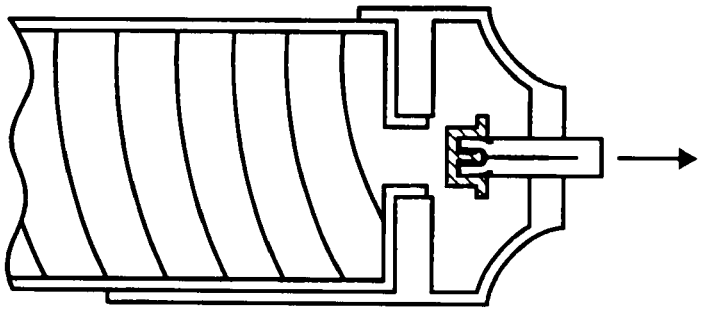
FIG. 9C is a schematic chart of the toner bottle when a collet chuck removes the cap.
Figure 16:
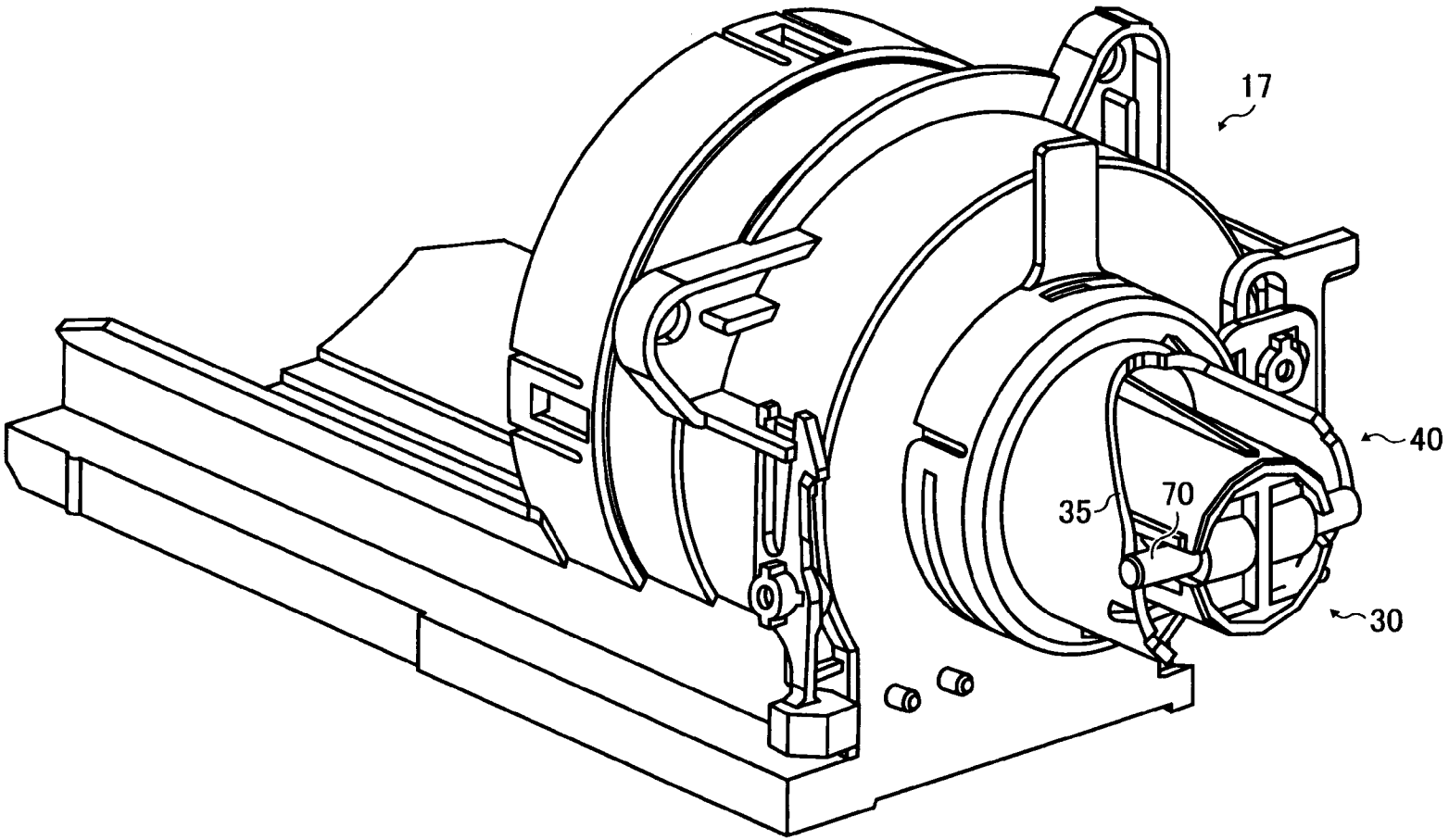
FIG. 16 illustrates a perspective view of the cam device when the opening of the toner bottle is open.
Figure 17:
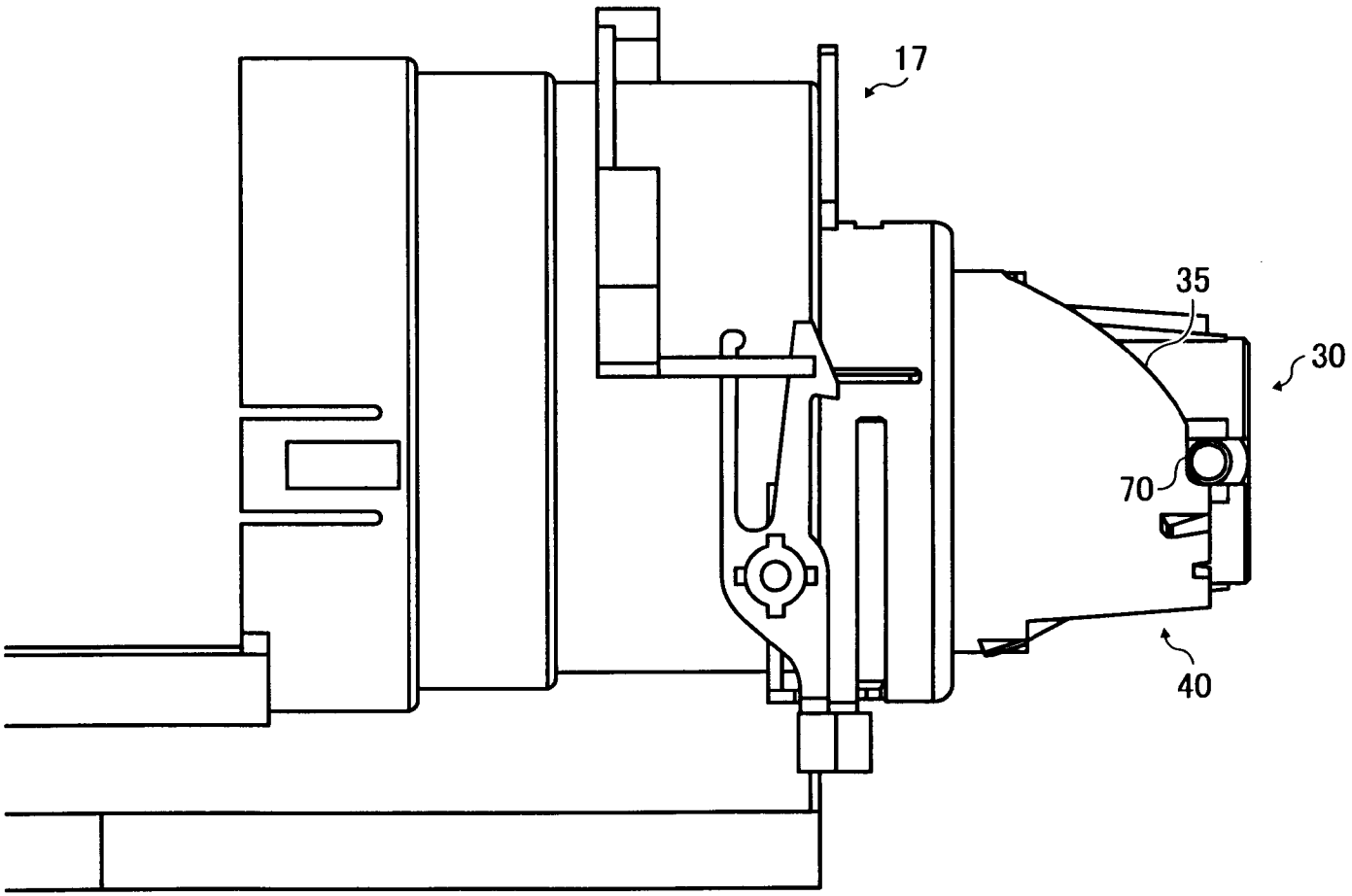
FIG. 17 illustrates a front view of the cam device when the opening of the toner bottle is open.
Figure 18:
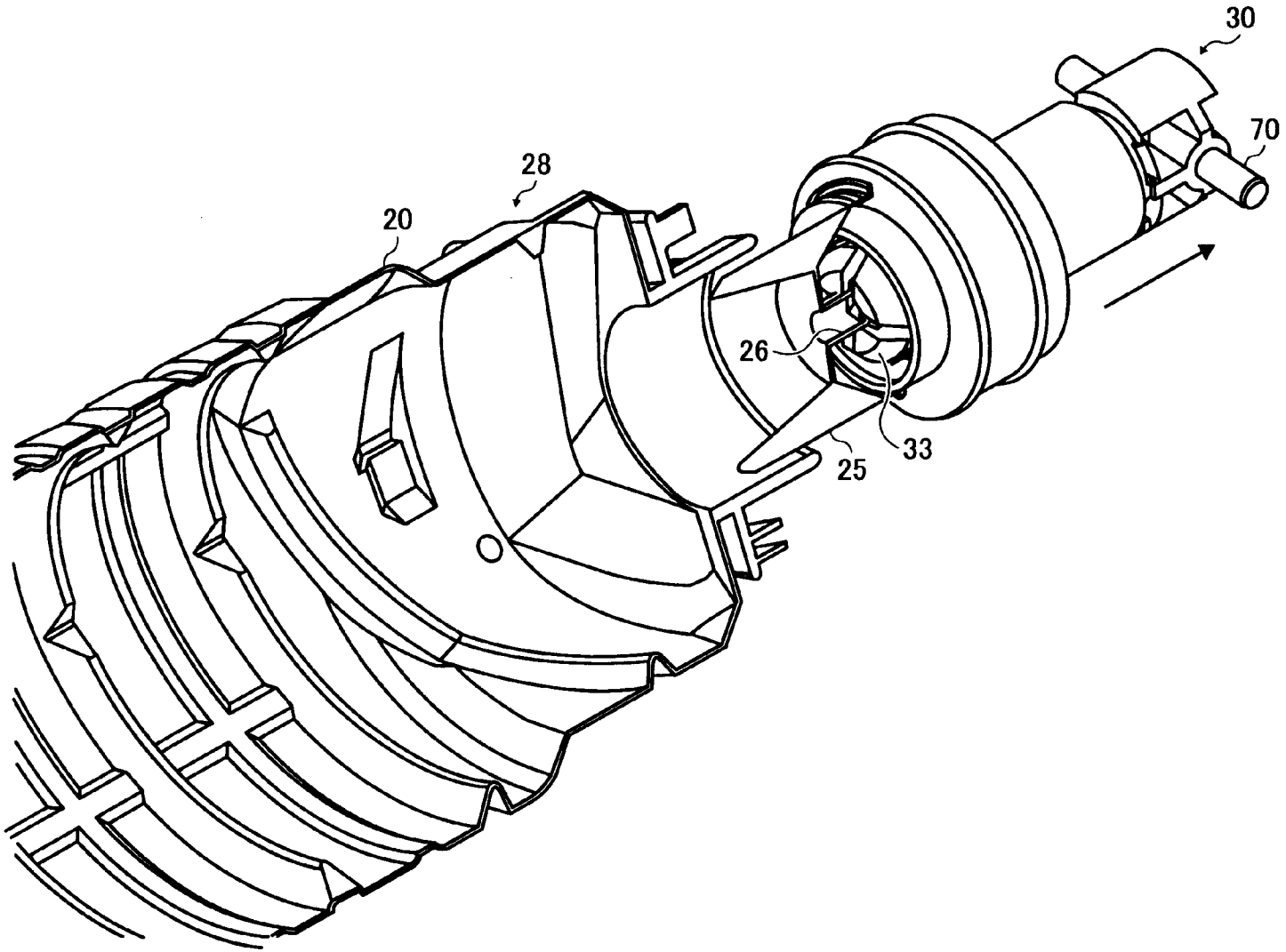
FIG. 18 is a perspective view illustrating the toner bottle when the cap is removed while a grasping portion of the collet chuck grasps a knob of the cap.

As shown in FIGS. 16 and 17, since the body 40 of the cam device 40 further rotates in the direction E in conjunction with the swinging of the operation lever 41, the moving member 70 positioned at the middle of the cam surface 35 is further distanced from the toner bottle 20 along the cam surface 35, and finally positions at the farthest therefrom. Since the moving member 70 is farthest, the collet chuck also moves further apart from the toner bottle 20. In this way, since the collet chuck 30 is distanced with the grasping section 33 grasping the knob 26 and the cap as shown in FIG. 18, the cap 25 can be removed from the opening 23 and completely open the opening as shown in FIG. 9C.

Figure 19:
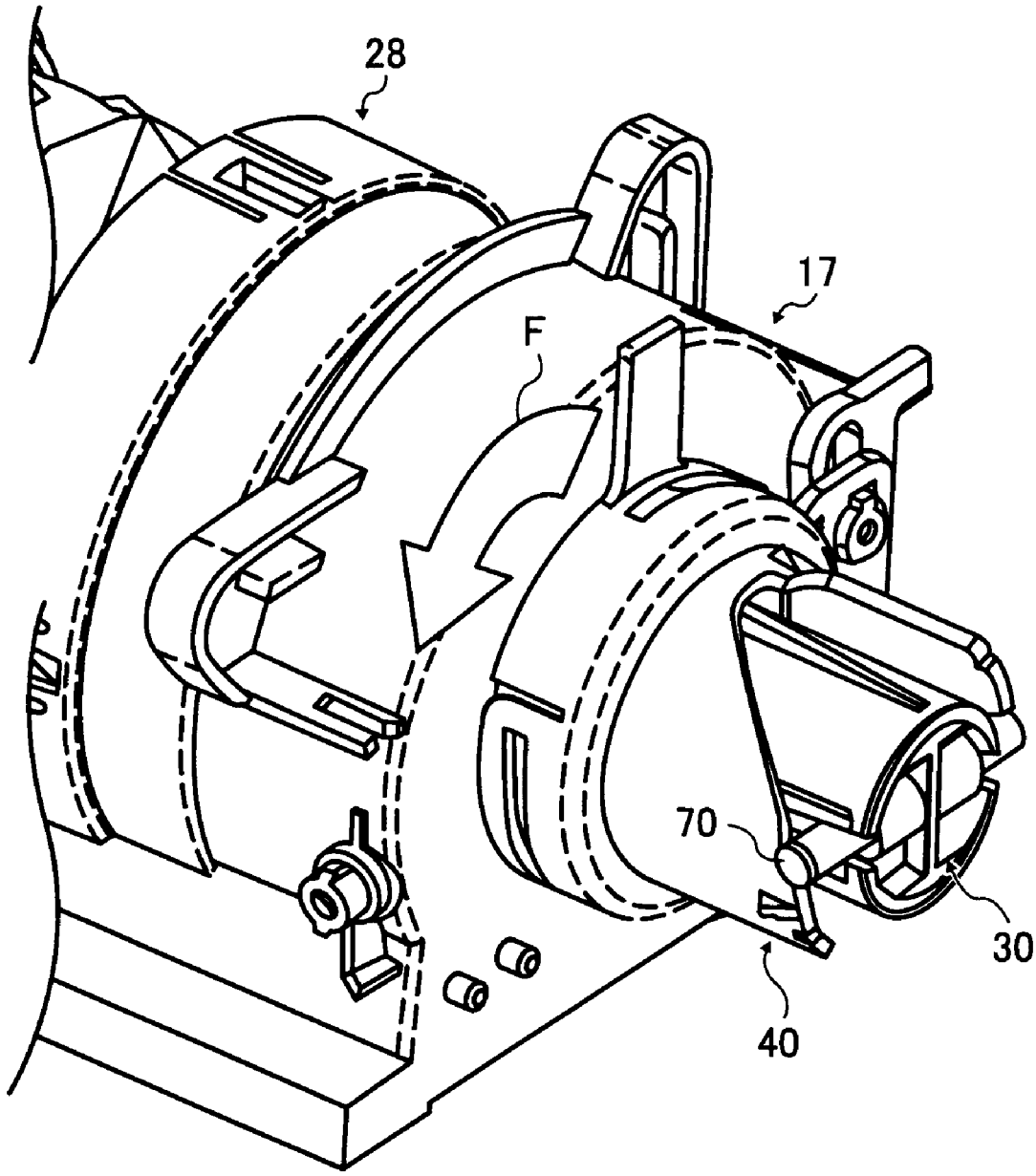
FIG. 19 illustrates an exemplary swinging operation of the operation lever when the cap of the toner bottle seals the opening of the toner bottle.

Since such a mechanism for removing the cap 25 is arranged in the toner bottle unit 17, the toner bottle 20 can be placed on the bottle holder 21 with the opening 23 being sealed with the cap 25, and toner leakage from the opening 23 can be avoided even when the toner bottle 20 is almost horizontally placed on the bottle holder 21. When toner in the toner bottle 20 is used up and emptied, and accordingly the toner bottle 20 is to be detached from the bottle holder 21, an operation opposite to that described above is executed. That is, as shown in FIG. 19, the operation lever 41 swings in the direction F from noon to nine O'clock, and the collet chuck 30 is moved to approach the toner bottle 20 by means of the cam device 40. Then, the cap 25 is attached to the opening 23 of the toner bottle 20. Thus, since the opening 23 is sealed with the cap 25 when the toner bottle 20 is to be detached from the bottle holder 21, toner sticking to the opening does not drop and contaminates hand and cloth of an operator.

Now, an operation for replacing a toner bottle 20 is described. When the toner bottle 20 is withdrawn and detached from the bottle holder 21, the cap is initially attached to the opening 23 in the above-mentioned manner so as to avoid leakage of the toner from the opening 23 during a toner bottle replacement. Specifically, the operation lever 41 is swung in the direction F from noon to nine O'clock, and the collet chuck holding the cap 25 is accordingly moved to the opening 23. Then, the cap 25 is inserted into the collar 24 and seals the opening 23. At this moment, since the collet chuck 30 moves toward the opening 23, and a restoring force of the collet chuck 30 opens the grasping section 33, the knob 26 of the cap 25 can be released. After that, the bottle holder 21 is moved to the bottle placing position A from the toner replenishing position B. Then, at the bottle placing position A, an operator extracts the toner bottle 20 from a stopper cover 28, and detaches the toner bottle 20 from the bottle holder 21.

Then, the old bottle 20 is replaced with a new at the bottle placing position A. Specifically, the new toner bottle 20 filled with toner and sealed by a cap 25 is set to the bottle holder 21 with its head directing the stopper cover 28, and the head is inserted into the stopper cover 28. Then, by pushing a semispherical hole 42 formed on the operation lever 41, the operator moves the bottle holder 21 from the bottle placing position A toward the toner replenishing position B. Then, the opening 23 is open in the above-mentioned manner by detaching the cap 25. Thus, as mentioned above, the toner can be ejected via the opening 23 by means of rotation of the toner bottle 20.

Further, as mentioned above, the operation lever 41 swings substantially around the axis extending through the bottle holder placing position A to the toner replenishing position B on a plane perpendicular to the axis. Thus, when the bottle holder 21 is moved from the positions A to B, since a portion of the operation lever to be pushed (i.e., a semispherical hole 42) exists on the axis, a component of a force of pushing the operation lever by the user cannot swing the operation lever due to a moment theory even though the component is applied to the operation lever 41 in the swingable direction. Thus, the operation lever 41 is not swung, and accordingly the cap 25 is hardly removed from the opening 23 even though the pushing force applied to the toner bottle unit 17 tends to swing the operation lever 41 when the user installs the bottle holder 21 into the apparatus body.

However, a user likely erroneously swings the operation lever 41 directly during replacement of the toner bottle 20 and the cap 25 can be removed from the opening 23. According to this embodiment, a device is further provided to suppress such an erroneous operation of the user.

Figure 20:
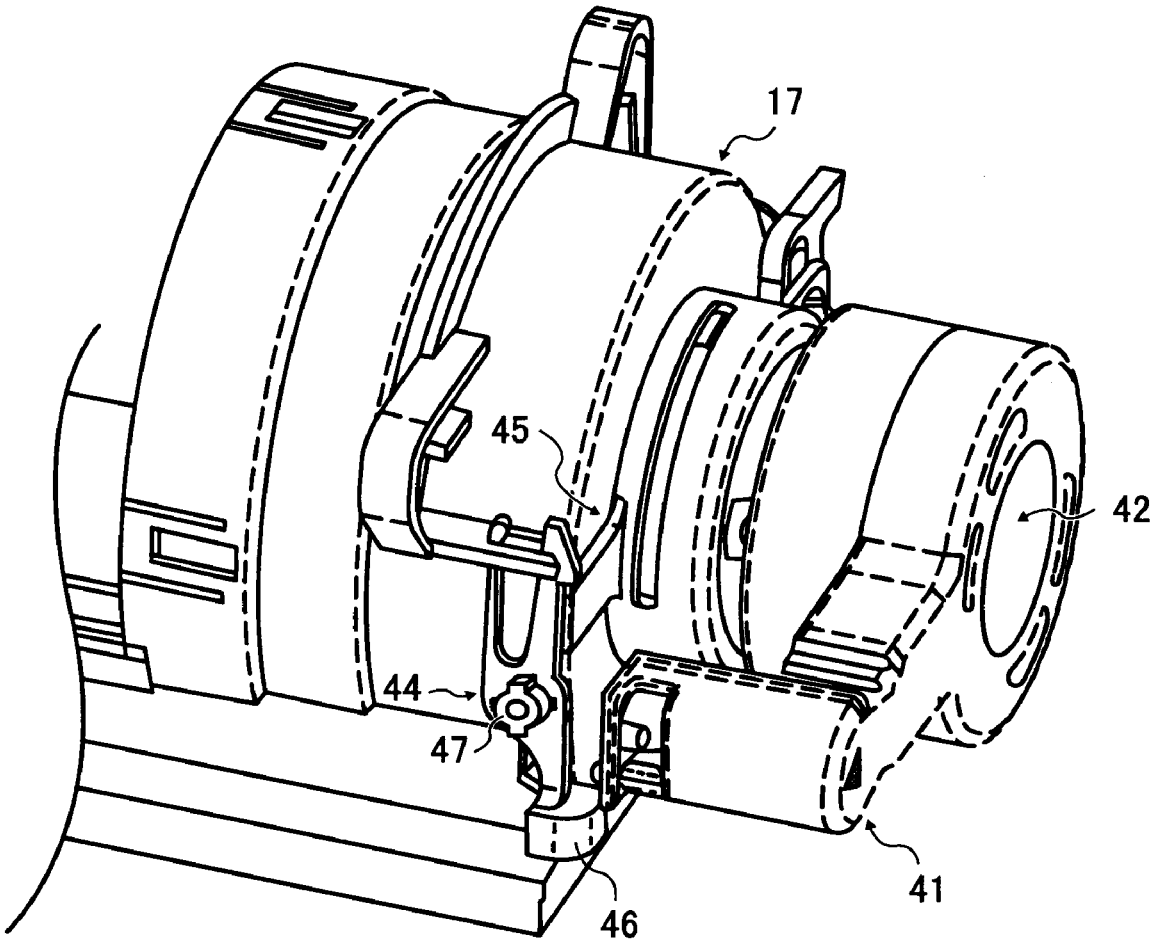
FIG. 20 is a schematic chart illustrating an exemplary condition where rotation of the operation lever is inhibited by an engagement of a locking member with a locked member.

According to the embodiment, as shown in FIG. 20, a locking member 44 and a locked member 45 engaging with the locking member 44 are arranged in the toner bottle unit 17 so as to inhibit the rotation of the operation lever 41 from nine O'clock. The locked member 45 is enabled to swing in synchronism with the operation lever 41.

As understood from FIG. 20, when the operation lever 41 is positioned at the nine O'clock. Specifically, the cap 25 seals the opening 23, the locked member 45 engages with the locking member 44 and thereby inhibits the rotation of the operation lever 41. Thus, even though the user unintentionally swings the operation lever 41 during replacement of the toner bottle 20, the operation lever 41 is not practically swung. Because, swing of the operation lever 41 is inhibited by the locking and locked members 44 and 45. Accordingly, the cam mechanism 40 does not operate, and as a result, scatter of the toner through opening 23 from the storage of the toner bottle 20 can be suppressed when the toner bottle 20 is replaced. This is because, the collet chuck 30 does not remove the cap 25 from the opening 23.

Figure 21:
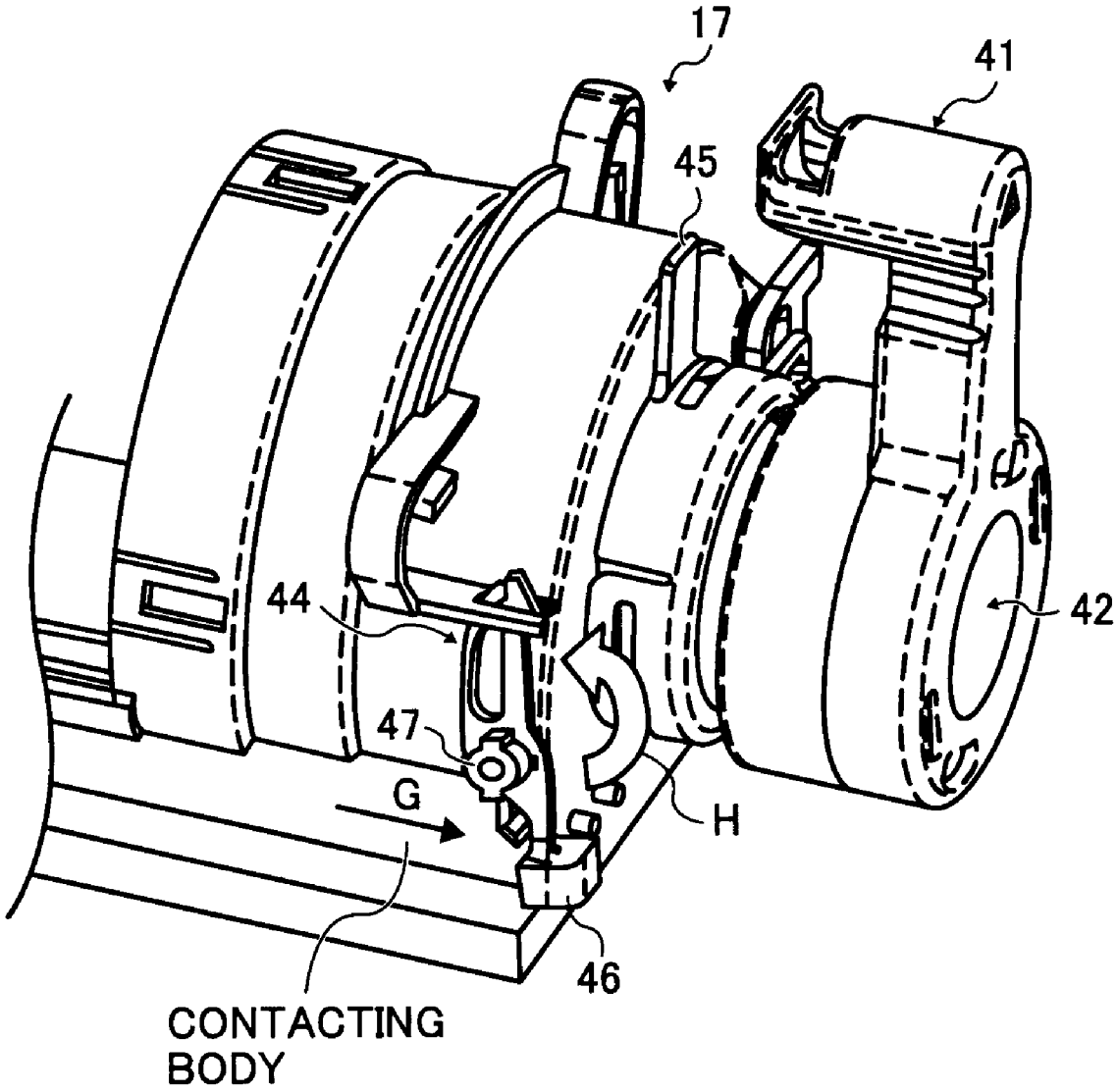
FIG. 21 is a schematic view illustrating an exemplary condition where the locking member is disengaged with the locked member.

Admitting that it is possible to avoid erroneous removal of the cap 25 of the toner bottle 20 when the toner bottle 20 is replaced by means of the locking and locked members 44 and 45 in one hand, it is needed to disengage the locking and locked members 44 and 45. Because, the cap 25 is necessarily removed when toner stored in the toner bottle 20 is replenished to the developing device. Thus, according to this embodiment, as shown in FIG. 21, a lock releasing member 46 is arranged on the locking member 44 at its one side opposite to that engaging with the locked member. The lock releasing section 46 is enabled to contact the supporting member 22 arranged in the apparatus body when the toner bottle unit 17 moves from the positions A to B. Specifically, when the lock releasing section 46 contacts the supporting member 22, and is biased in a direction as shown by an arrow G, the locking member 44 rotates in a direction as shown by an arrow H around a rotational shaft 47. Owing to the release of the engagement (disengagement) of the locking and locked members caused by the rotational operation, the operation lever 41 can be swung from nine O'clock to noon as shown in FIG. 21.

Thus, according to this embodiment, since swinging of the operation lever 41 is inhibited by means of the locking and locked members 44 and 45 when the toner bottle unit 17 is positioned other than the toner replenishing position B, and the lock of inhibiting the rotation of the operation lever 41 is released when the toner bottle unit 17 is attached to a prescribed position in the apparatus body, i.e., the toner replenishing position B, the cap is not erroneously removed credibly, for example when the toner bottle 20 is replaced. In addition, by simply attaching the toner bottle unit 17 to a prescribed position in the apparatus body, the inhibition of the singing of the operation lever 41 can be released. Further, since a special operation for releasing the inhibition is not needed by the user, the cap 25 of the toner bottle 20 can be open without labor of the user.

When the toner bottle unit 17 is to be moved from the positions B to A, the operation lever 41 is initially swung from noon to nine o'clock and seals the opening 23 with the cap 25. After that, the toner bottle unit 17 is withdrawn from the apparatus body. However, unless the swinging of the operation lever 41 is inhibited by means of the locking and locked members 44 and 45 at the moment, the cap 25 is likely erroneously removed as mentioned above. Thus, when the toner bottle unit 17 is withdrawn from the apparatus body, the locking and locked members 44 and 45 are engaged with each other.

Then, according to one embodiment, the locking member 44 includes elasticity, and its restoring force causes the locking member 44 to rotate in an opposite direction to that shown by an arrow H around the rotational axis 47 to move to a position, in which the locking and locked members engage with each other, when the toner bottle unit 17 is withdrawn from the apparatus body as shown in FIG. 20. Thus, since a special operation for engaging the locking member with the locked member is not needed, rotation of the operation lever 41 can be inhibited without labor of the user.

Figure 22:
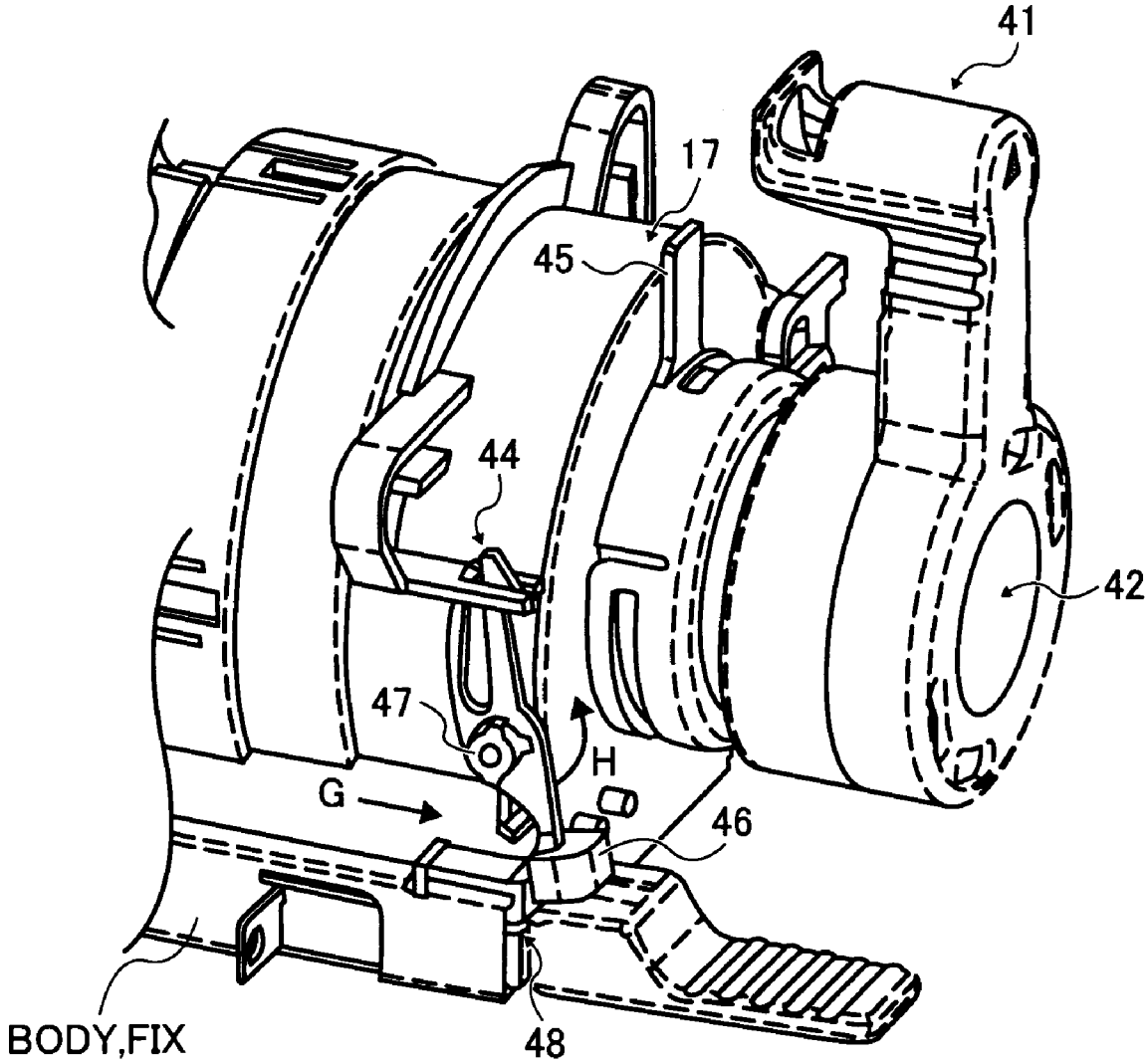
FIG. 22 is a schematic view illustrating an exemplary limit member for limiting movement of the toner bottle unit in the attachment and detachment directions of the toner bottle unit.

Further, according to this embodiment, a limitation member 48 for limiting movement of the toner bottle unit 17 is arranged at a position of the supporting member 22 in relation to the apparatus body as shown in FIG. 22. That is, if the movement of the toner bottle unit 17 from the positions B to A is freely allowed without any limitation when the user replaces the toner bottle 20, he or she likely excessively withdraws and drops the toner bottle unit 17 from the apparatus body. Thus, so that the toner bottle unit 17 is not withdrawn passing through the bottle holder placing position A when a user withdraws the toner bottle unit 17 from the apparatus body, the limiting member 48 limits the movement of the toner bottle unit 17. Thus, the dropout of the toner bottle unit 17 from the apparatus body caused by the excessive withdrawal thereof can be avoided.

When the toner bottle unit 17 is to be replaced, the limitation member 48 is detached from the apparatus body, and the toner bottle unit 17 is completely withdrawn from the apparatus body.

However, when the replacement of the toner bottle unit 17 is completed, the limitation member 48 is sometimes left detached from the apparatus body. As a result, the limitation member 48 can be lost or the toner bottle unit 17 drops from the apparatus body when replaced. Thus, when the toner bottle unit 17 is attached to a prescribed position of the apparatus body as shown in FIG. 1, a lock releasing section 46 is provided to contact the limitation member 48 and moves in a direction as shown by an arrow (G) . As a result, the locking member 44 rotates in the direction as shown by an arrow (H) around the rotational shaft 47, and the engagement of the locking and locked members 44 and 45 is dissolved. Thus, when the limitation member 48 is left detached from the apparatus body, and the toner bottle unit 17 is attached to the toner replenishing position B, the locking and locked members 44 and 45 are not disengaged with each other and swinging of the operation lever 41 is continuously inhibited. Thus, the user can notice of detachment of the limitation member 48, and the above-mentioned problem can be resolved.

Heretofore, an exemplary configuration capable of inhibiting removal of the cap 25 by means of erroneous swinging of the operation lever 41 by the user when he or she replaces the toner bottle 20 is described. As understood from the above, the inhibition of the swinging of the operation lever 41 created by the locking and locked members 44 and 45 can be released and the cap 25 can be removed from the toner bottle 20 when the toner bottle unit 17 is attached to a prescribed position in the apparatus body. However, the toner bottle unit 17 is likely withdrawn from the apparatus body while the cap 25 is removed from the toner bottle 20 when the operation lever 41 is not swung from noon to nine o'clock. Thus, as shown in FIGS. 23 and 24, the apparatus body and the toner bottle unit 17 are enabled to engage with each other by means of an engaging section 49 arranged in the apparatus body and an engaged section 50 arranged on the operation lever 41.

Figure 23:
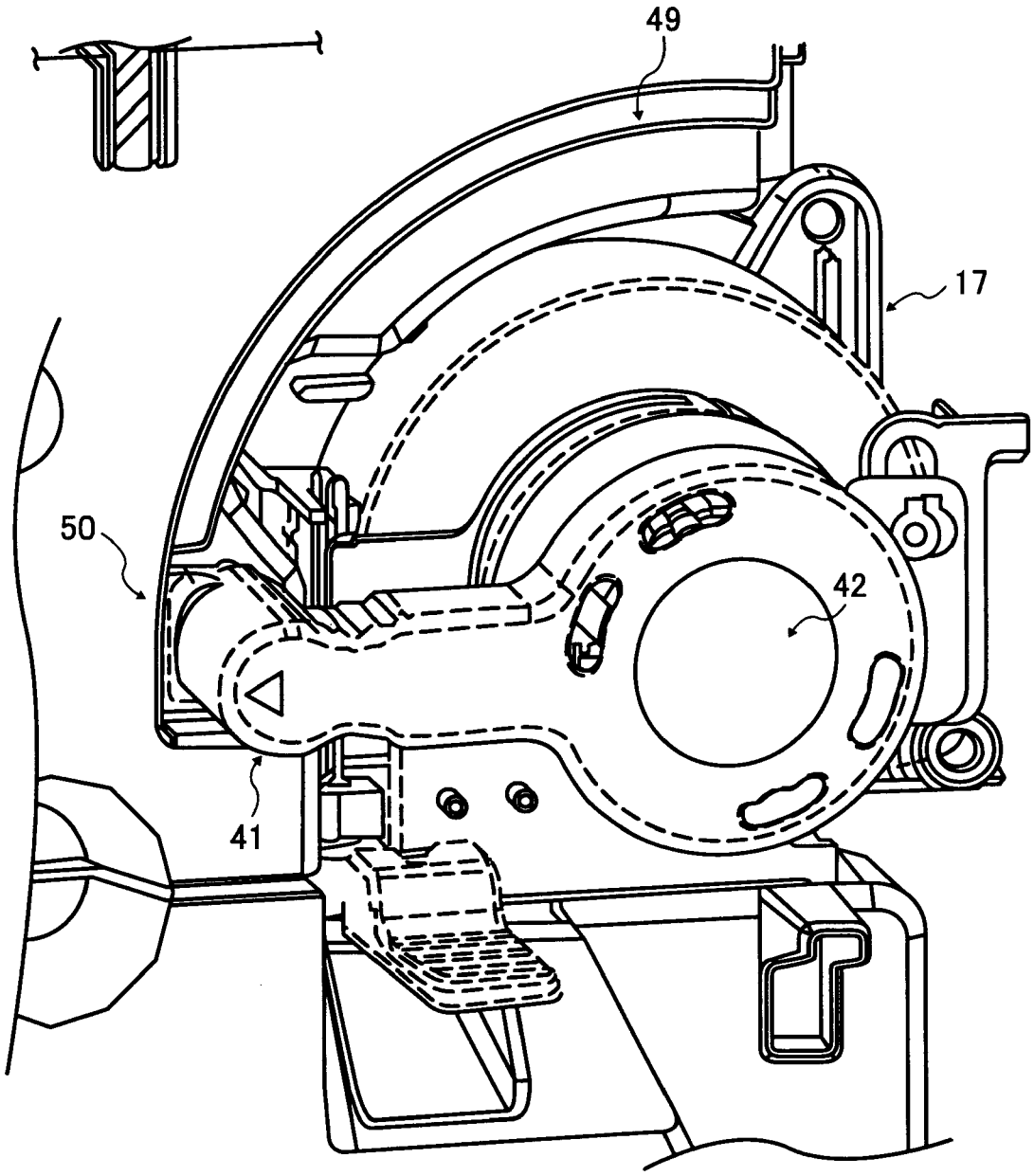
FIG. 23 is a schematic view illustrating an exemplary condition where the attachment and detachment of the toner bottle unit is not inhibited by the engaging and engaged sections.

In this embodiment, as shown ion FIG. 23, only when the opening is sealed with the cap 25, specifically, the operation lever 41 is only positioned as nine o'clock, the engaging section 49 is designed not to be engaged with the engaged section 50, thereby the toner bottle unit 17 is detachable from and to the apparatus body.

Figure 24:
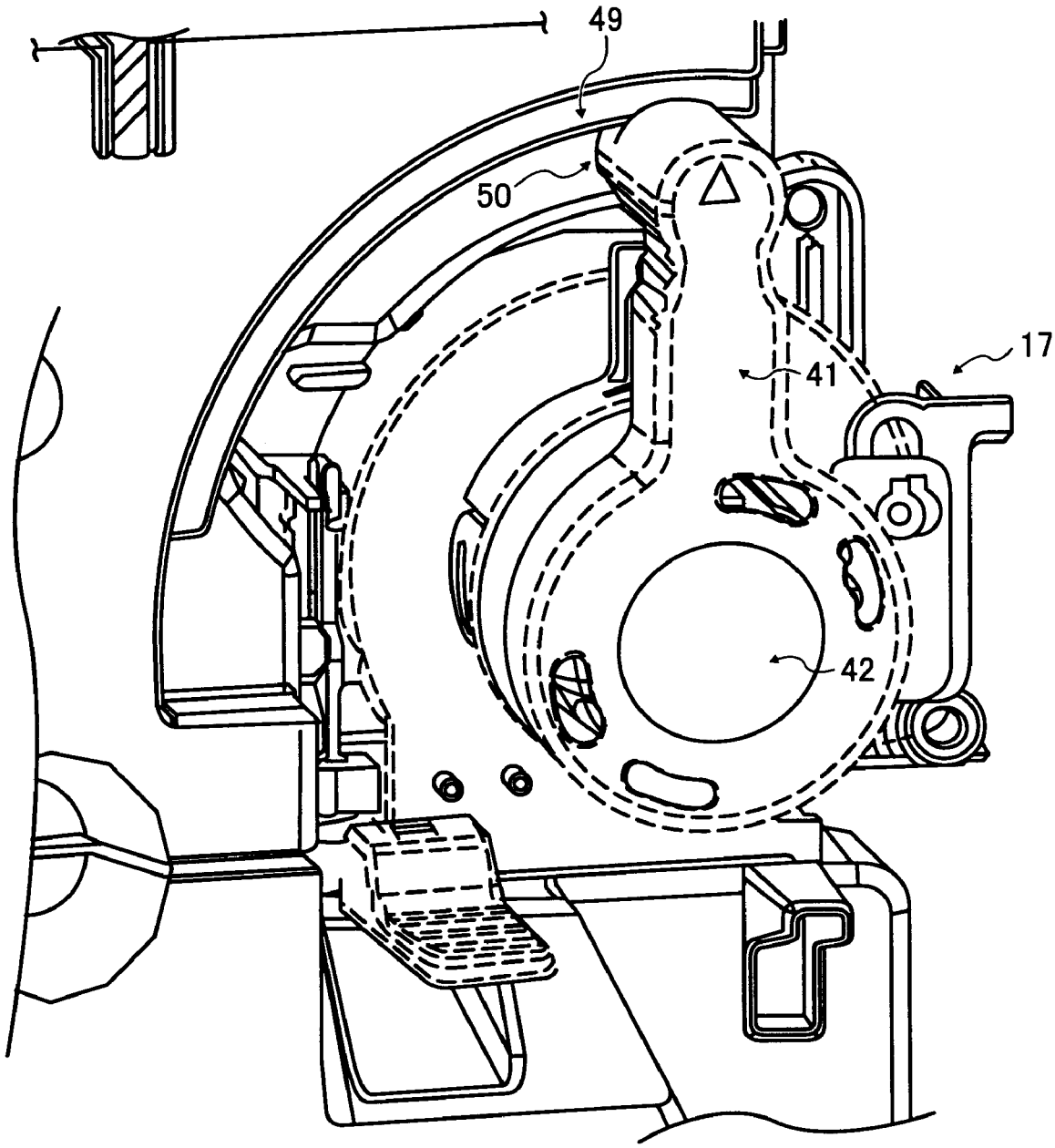
FIG. 24 is a schematic view illustrating an exemplary condition where attachment and detachment of the toner bottle unit is inhibited while the engaging section engages with the engaged sections.

When the operation lever 41 is positioned other than nine o'clock, for example at noon as shown in FIG. 24, the engaging section 49 engages with the engaged section 50, and thereby the toner bottle unit 17 is not detachable from and to the apparatus body. Thus, the toner bottle unit 17 is not withdrawn from the apparatus body while the opening remains open because of removal of the cap 25 from the toner bottle 20.

When the operation lever 41 is positioned between nine o'clock and noon, the opening is not completely sealed with the cap 25, that is, the opening is partly open. In such a state, toner likely leaks from the toner bottle 20 through a gap between the opening 23 and the cap 25. Thus, if not only when the opening 23 is completely open as the operation lever 41 positions at noon, but also when it is positioned other than nine o'clock, the engaging section 49 engages with the engaged section 50 and thereby the toner bottle unit 17 cannot be withdrawn from the apparatus body, toner scatter from the opening 23 can be credibly suppressed during the replacement of the toner bottle 20.

Now, exemplary replenishment of toner from a toner bottle unit 17 to an apparatus body is described. When the toner bottle 20 is rotated by a bottle rotation driving device, not shown, while the opening 23 of the toner bottle 20 is open, toner contained inside is gradually conveyed by the rotation toward the opening 23, because the earlier mentioned spiral guide groove 27 is arranged on an inner wall surface of the toner bottle 20. Then, by means of toner conveyance device not shown conveys the toner ejected from the opening 23 to a hopper 16 serving as a toner container. The toner then travels a toner conveyance path 51 arranged in the hopper 16 and is replenished to a developer conveyance path of a developing device 5, in the apparatus. Further, a shutter mechanism 60 is arranged in the toner conveyance path 51 and causes a shutter member 61 to close the toner conveyance path 51 without leakage of toner remaining therein. The shutter mechanism 60 opens the toner conveyance path 51 so that the toner can be replenished from the toner bottle unit 17 to the apparatus body when the toner bottle unit 17 is located at the prescribed position in the apparatus body.

Figure 25:
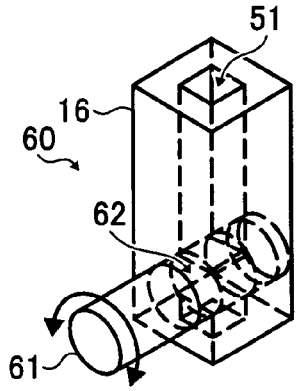
FIG. 25 is a schematic chart illustrating an exemplary shutter mechanism according to one embodiment of the present invention.
Figure 26A:
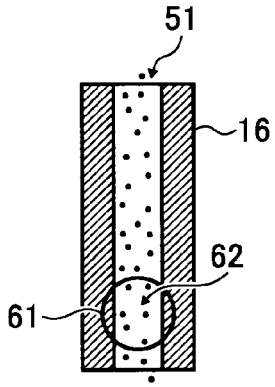
FIG. 26A is a schematic chart illustrating an exemplary toner conveyance path in the state of being open.

Now, an exemplary shutter mechanism 60 is described more in detail. As shown in FIG. 25, the shutter member 61 is a cylindrical and is capable of contacting an inner wall of a cylindrical hole formed on the hopper 16 so as to intersect with the toner conveyance path 51. The shutter member 61 includes a penetration hole 62 penetrating through a circumferential surface thereof. The shutter 61 thus opens and closes the toner conveyance path 51 by rotating around the longitudinal axis of the cylindrical hole in the cylindrical hole thereby changing a position of the penetration hole 62. Specifically, as shown in FIG. 26A, by rotationally changing the shutter member 61 to a position, the toner conveyance path 51 is communicated with the penetration hole 62 and open.

Figure 26B:
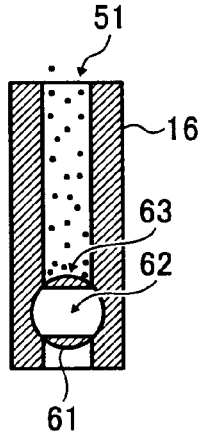
FIG. 26B is a schematic chart illustrating an exemplary toner conveyance path in the state of being closed.

Further, as shown in FIG. 26B, by rotationally changing the shutter member 61 to another position, the toner conveyance path 51 is closed by the circumferential surface 63.

This is because, when a shutter mechanism 60 arranged in a toner bottle unit 17 is used for a long time, toner generally sticks to and is accumulated on an inner wall of a shutter member 61 and a toner conveyance path 51. As a result, a gap is created by the accumulation of the toner at a contact between a shutter member 61 and a toner conveyance path 51. When the gap is created at the contact in this way, since the toner conveyance path 51 cannot be completely closed by the shutter member 61, toner leaks through the gap.

Thus, according to this embodiment, by constituting the shutter mechanism 60 with the above-mentioned cylindrical hole and the cylindrical shutter member 61, the shutter member 61 can tightly contact the surface wall of the cylindrical hole to prevent the toner from invading between the shutter member 61 and the wall surface of the cylindrical hole, especially in the toner conveyance path 51. Thus, the gap caused by the toner existence between the shutter member 61 and the wall surface of the cylindrical hole can be suppressed. Thus, since the shutter member 61 credibly closes the toner conveyance path 51, the toner can be suppressed to leak from the toner conveyance path 51 in the closing state. The cylindrical shutter member 61 is capable of readily creating high precision at low cost using a drilling machine or a lathe turning machine.

Figure 27:
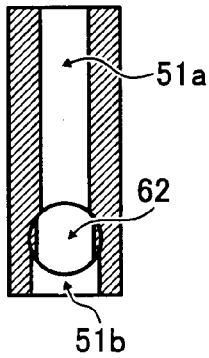
FIG. 27 is a schematic chart illustrating the widthwise relation between the toner conveyance path and the opening, such that the width of the toner conveyance path upstream of the shutter member is wider than that of the opening of the shutter member, and that of the opening is wider than that of the toner conveyance path downstream of the shutter member.
Figure 28:
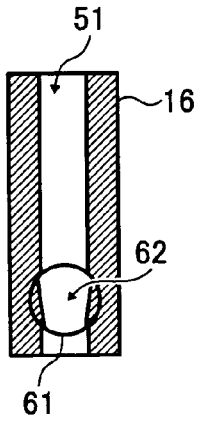
FIG. 28 is a schematic chart illustrating an exemplary shutter member having a tapered portion at its opening section.

Further, as shown in FIG. 27, when the shutter member 61 is communicated with the toner conveyance path 51, widths of the toner conveyance path 51 and the penetration hole 62 can be designed such that the width of toner conveyance path 51*a* upstream of the shutter member 61 in a toner conveyance direction is smaller than that of the penetration hole 62, and the width of the penetration hole 62 is smaller than the toner conveyance path 51*b* downstream of the shutter member 61. As shown in FIG. 28, the penetration hole 62 can be tapered such that the width thereof is larger at the upstream side than that at the downstream side in the toner conveyance direction. With the above-mentioned devices, a change in flow path load caused by an evenness of a change in a rotational amount of the shutter 61 can be minimized. Specifically, a position of the penetration hole 62 does not deviate from the position in which the penetration hole 62 of the shutter 61 is completely communicated with the toner conveyance path 51, and accordingly the circumferential surface 63 of the shutter 61 does not protrude into the toner conveyance path 51 even slightly. Thus, a problem of less amount of replenishment of toner than expected to the apparatus body side, which is caused by the accumulation of the toner on the circumferential surface, can be suppressed.

Further, toner conveyed through a toner conveyance path 51 sometimes accumulates on the inner wall of the toner conveyance path 51 as time elapses, and thereby the apparatus body is supplied with less amount of the toner than expected as a problem.

Figure 29:
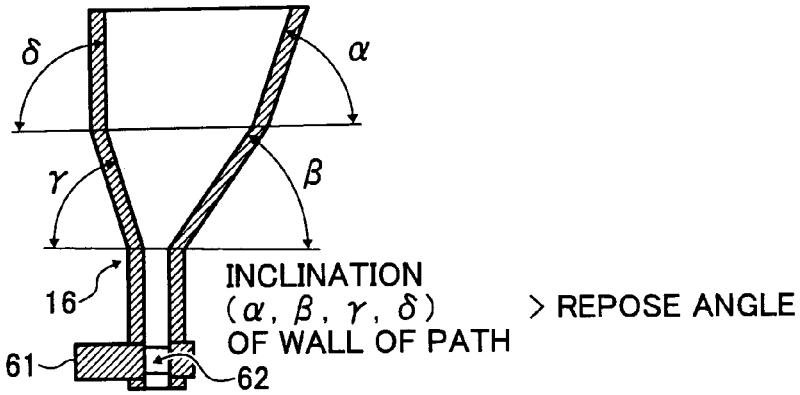
FIG. 29 is a schematic chart illustrating an exemplary toner conveyance path having inclinations larger than a repose angle of toner on its inner wall.

Then, according to this embodiment, the inner wall of the toner conveyance path 51 includes inclinations $\alpha$, $\beta$, $\gamma$ and $\delta$ larger than a repose angle toner as shown in FIG. 29. The repose angle represents the maximum angle made by slant and horizontal planes when powder such as toner is stably piled without collapsing. Thus, with the inclinations $\alpha$, $\beta$, $\gamma$ and $\delta$, the toner moves from the inner wall under the gravity regardless of a friction coefficient of the inner wall and a fluidity of the toner. Thus, the toner is not accumulated easily. Further, the above-mentioned problem of the shortage of toner replenishment can be moderated or resolved.

Figure 30:
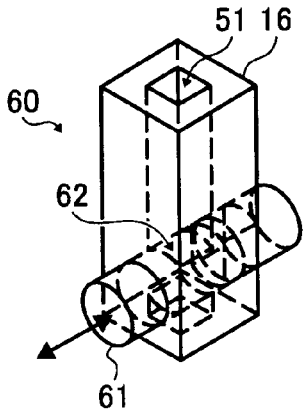
FIG. 30 is a schematic chart illustrating an exemplary configuration that slides the shutter.
Figure 31A:
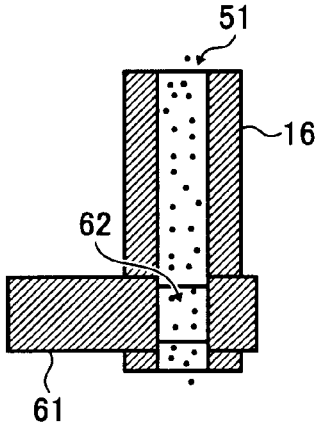
FIG. 31A is a schematic chart illustrating an exemplary toner conveyance path in the state of being open.
Figure 31B:
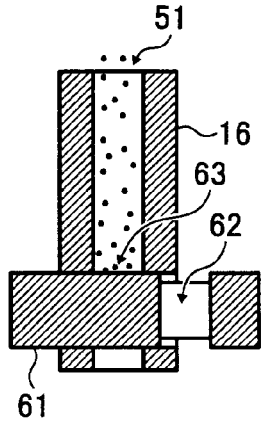
FIG. 31B is a schematic chart illustrating an exemplary toner conveyance path in the state of being closed.

The way of opening and closing the toner conveyance path 51 using the shutter mechanism 60 is not limited to the above, where the position of the penetration hole 62 is changed by rotating the shutter member 61 around the longitudinal axis of the cylindrical hole. For example, as shown in FIG. 30, the penetration hole 62 can be communicated with the toner conveyance path 51 by sliding the shutter member 61 and changing a position of the penetration hole 62 as shown in FIG. 31A. By similarly sliding the shutter member 61, the circumferential surface 63 of the shutter member 61 can close the toner conveyance path 51 as shown in FIG. 31B.

Figure 32:
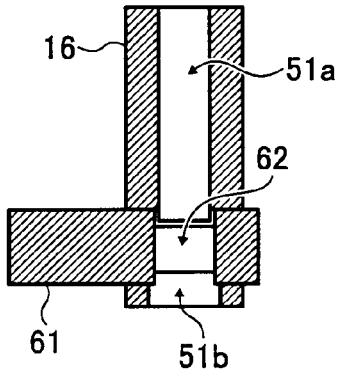
FIG. 32 is a schematic chart illustrating the widthwise relation between the toner conveyance path and the opening, such that the width of the toner conveyance path upstream of the shutter member is wider than that of the opening of the shutter member, and that of the opening is wider than that of the toner conveyance path downstream of the shutter member.
Figure 33:
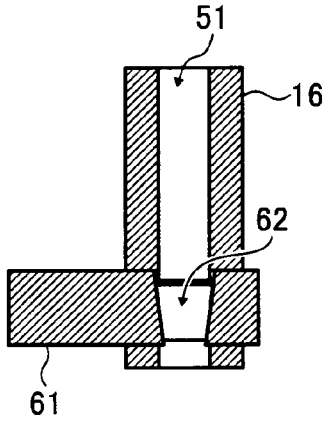
FIG. 33 is a schematic chart illustrating an exemplary shutter member having a taper at an opening section.

Further, as shown in FIG. 32, when the opening of the shutter member 61 is communicated with the toner conveyance path 51, widths of the toner conveyance path 51 and the penetration hole 62 can be designed such that the width of the toner conveyance path 51*a* upstream of the shutter member 61 in a toner conveyance direction is smaller than that of the penetration hole 62, and with of the penetration hole 62 is smaller than that of the toner conveyance path 51*b* downstream of the shutter member 61. Otherwise, as shown in FIG. 33, the penetration hole 62 can be tapered so that the width thereof is larger at the upstream side than at the downstream side in the toner conveyance direction.

With the above-mentioned configuration, a change in flow path load caused by an evenness of a change in sliding amount of the shutter 61 can be minimized.

Figure 34:
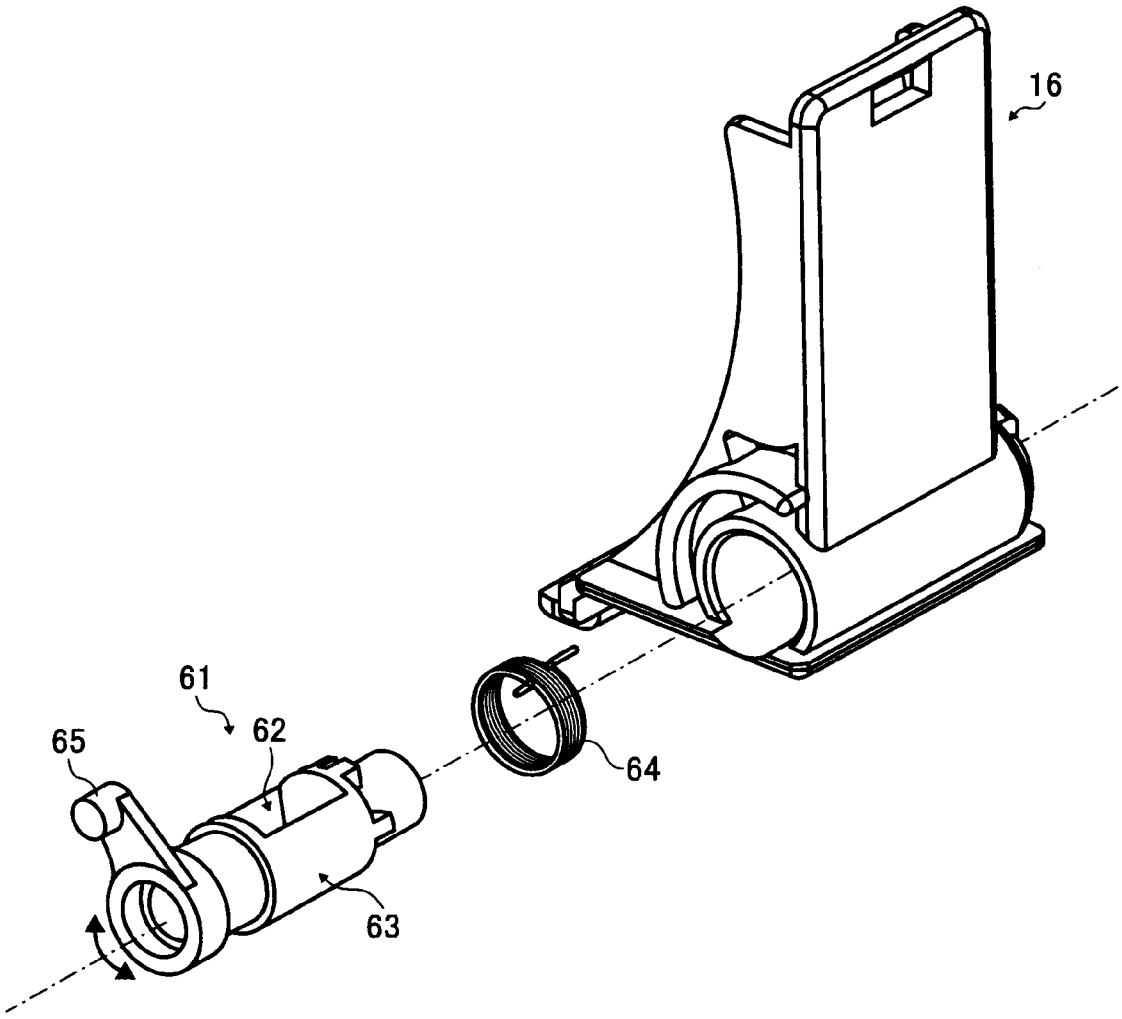
FIG. 34 is a schematic chart illustrating an essential member of the shutter mechanism.

Now, an exemplary toner bottle unit 17 including the above-mentioned shutter mechanism is described. As shown in FIG. 34, a cylindrical hole is formed to intersect with a hopper 16. A shutter member 61 is rotatably arranged within the hole via a spring member 64.

The shutter member 61 includes a handle 65 to be engaged with a supporting member 52 formed on the toner bottle unit 17 as mentioned later. The handle is enabled to rotate around a rotational axis of the shutter member 61 in conjunction with up and down movement of the supporting member 52.

Figure 35:
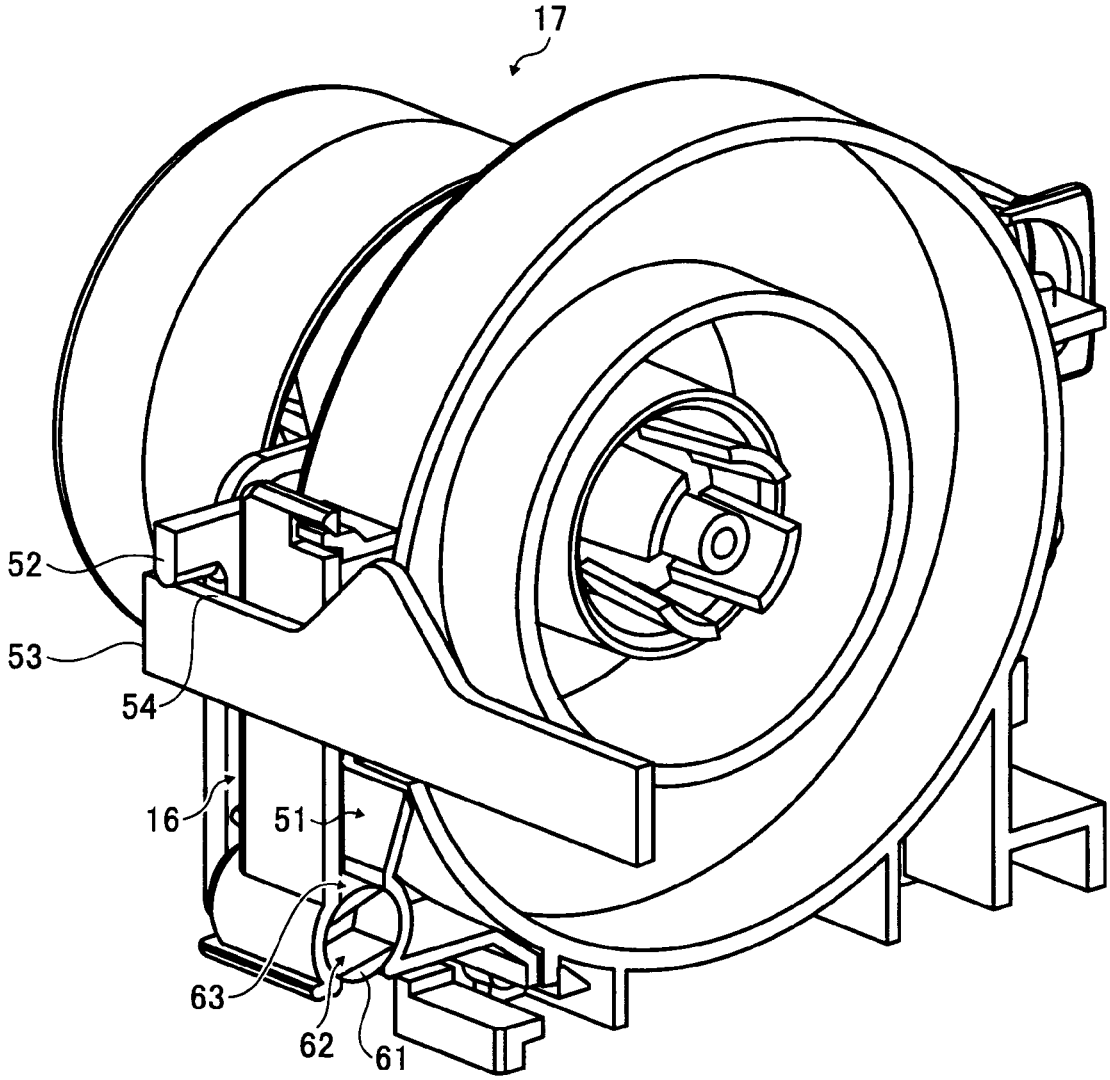
FIG. 35 is a schematic chart illustrating an exemplary condition of the shutter mechanism before the toner bottle is attached to the prescribed attachment position of the image forming apparatus body.
Figure 36:
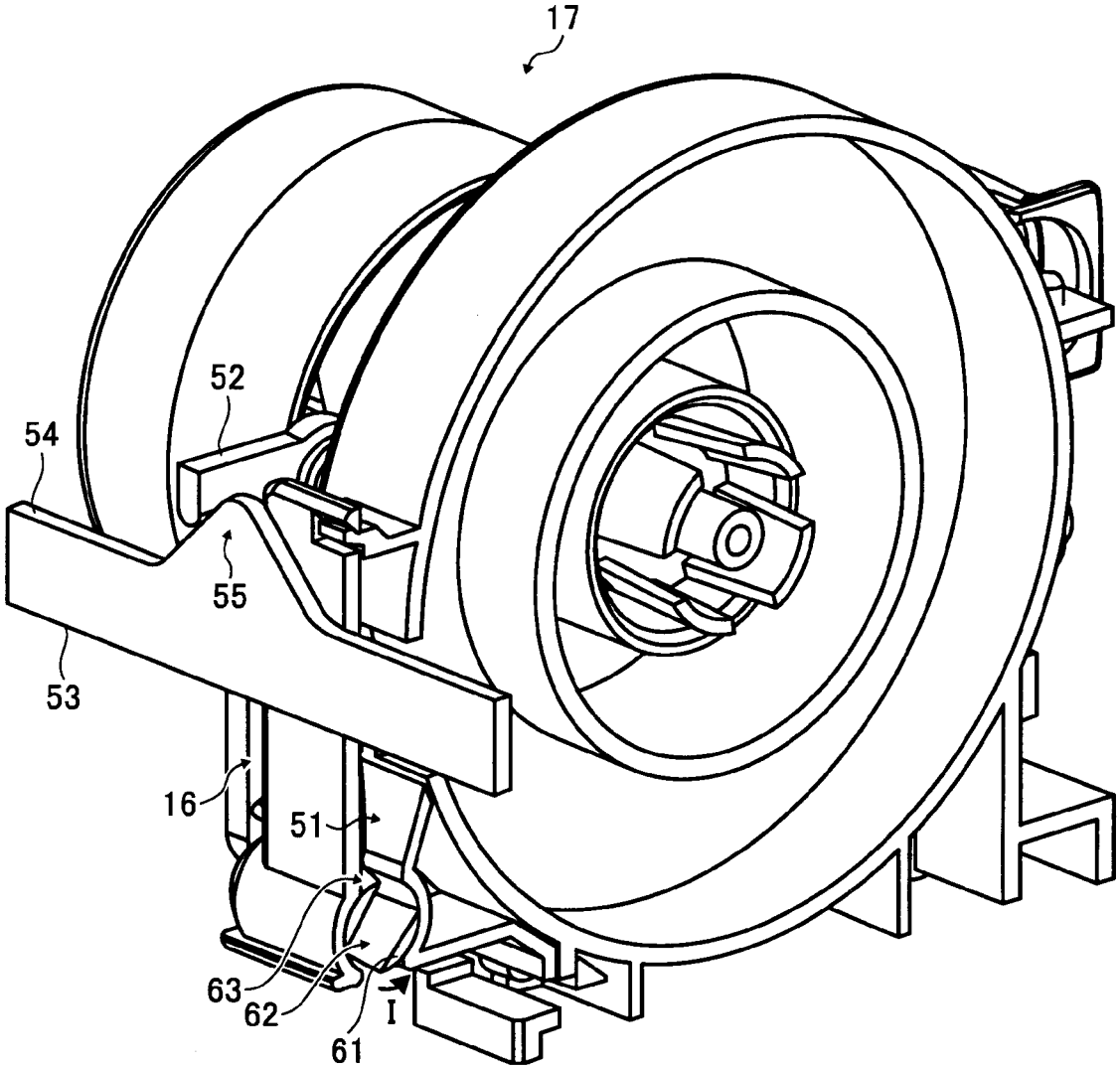
FIG. 36 is a perspective view illustrating an exemplary condition of the shutter mechanism during when the toner bottle is moved to the attachment position of the image forming apparatus body.
Figure 37:
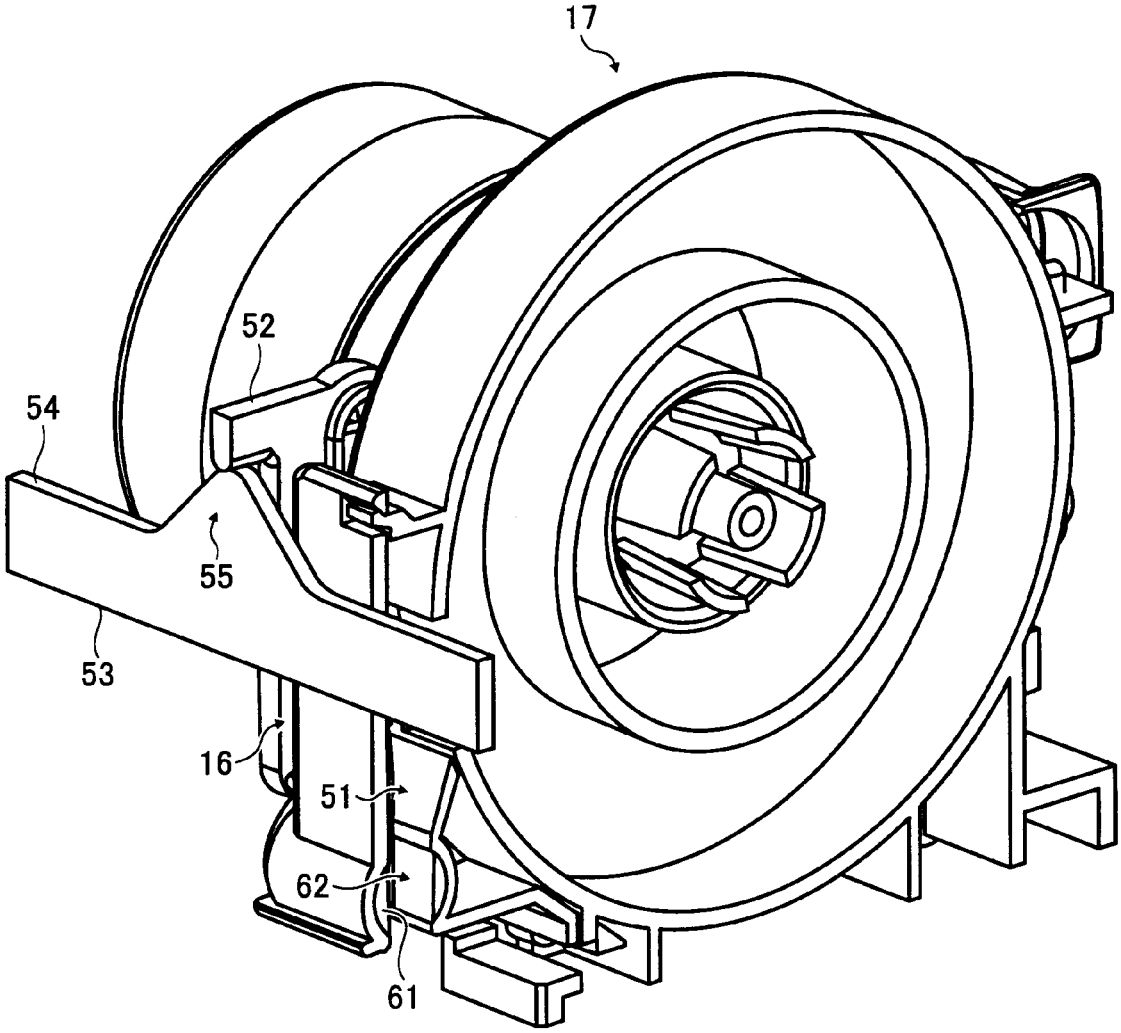
FIG. 37 is a perspective view illustrating an exemplary condition of the shutter mechanism when the toner bottle is (completely) attached to the attachment position.
Figure 38:
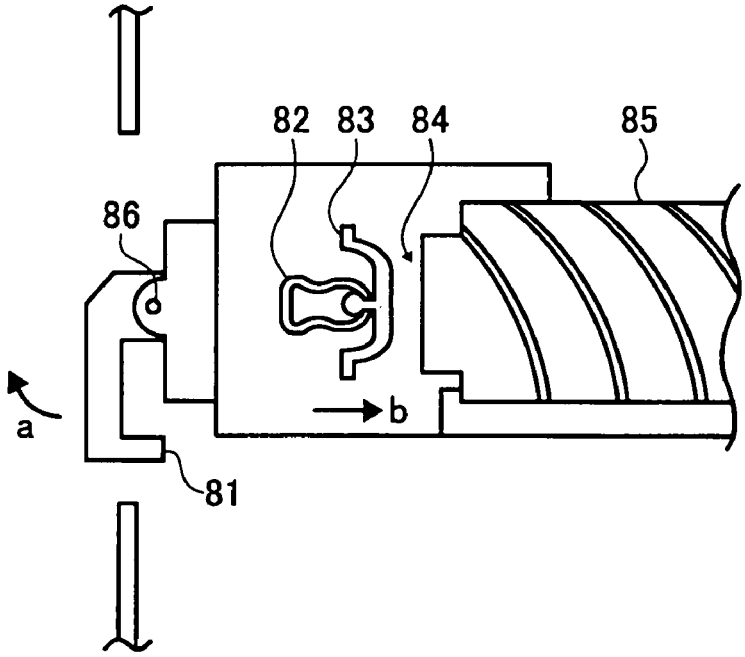
FIG. 38 illustrates a conventional operation for capping an opening of a toner bottle in a conventional toner bottle unit.
Figure 39:
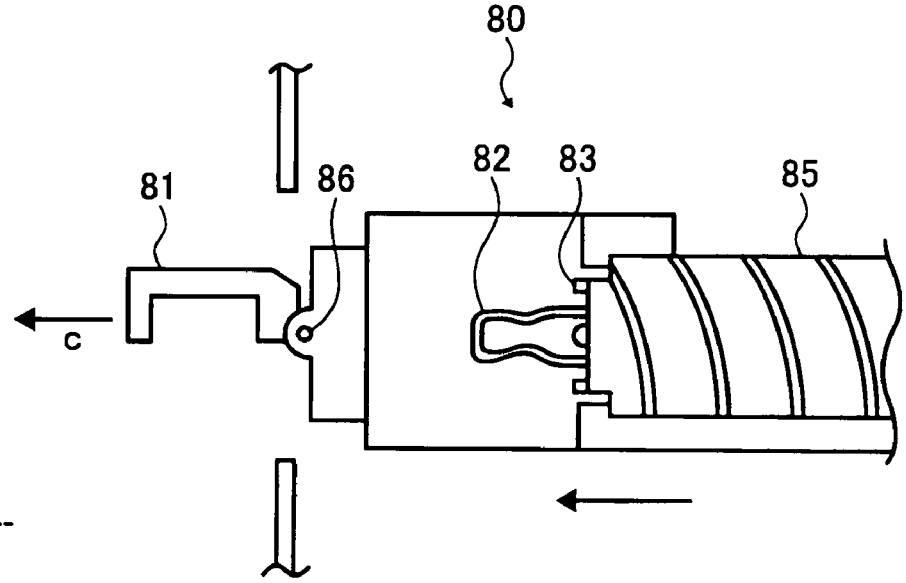
FIG. 39 illustrates a conventional operation for withdrawing a toner bottle unit from an image forming apparatus body.
Figure 40:
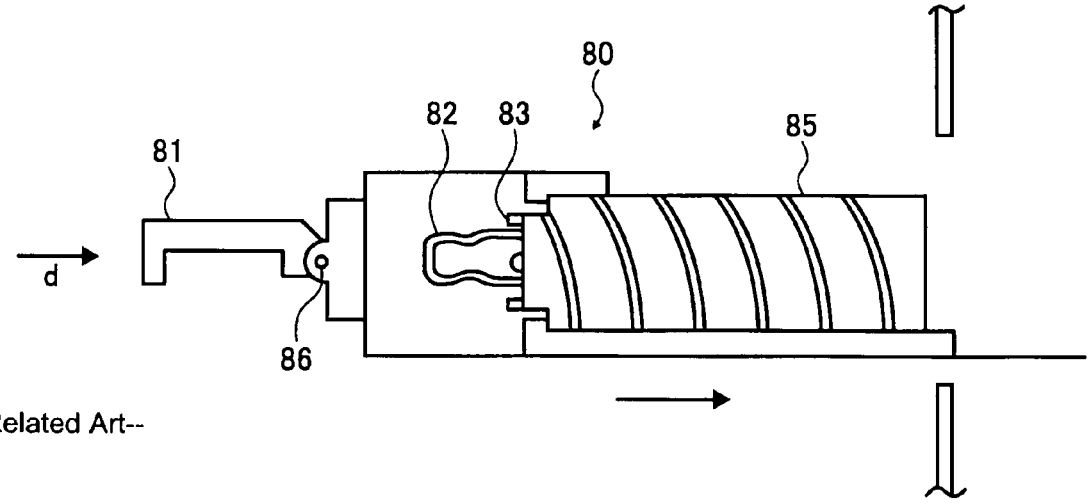
FIG. 40 illustrates a conventional operation for attaching the toner bottle unit to the image forming apparatus body.
Figure 41:
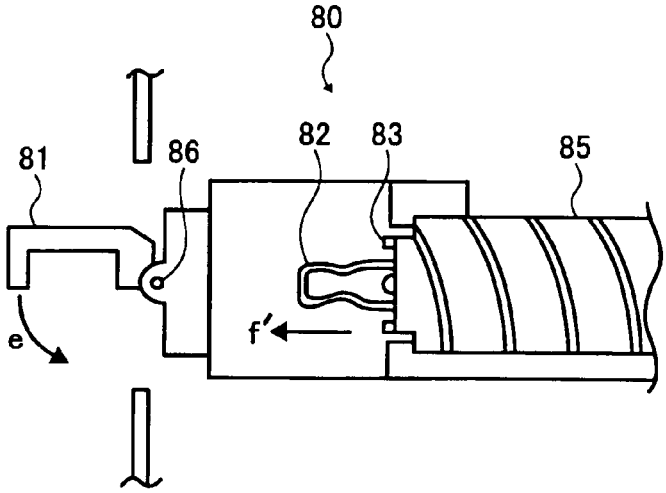
FIG. 41 illustrates an exemplary operation for removing the cap from the toner bottle.
Figure 42:
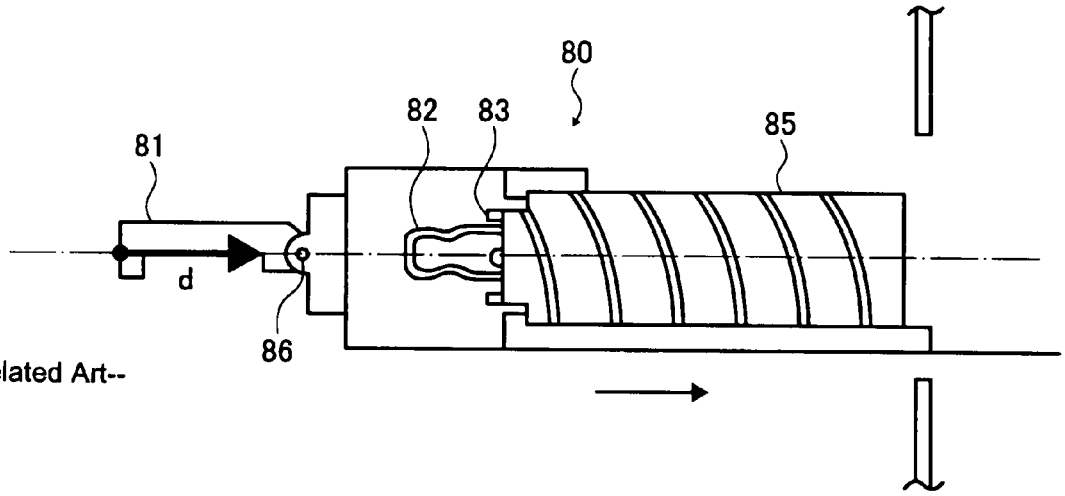
FIG. 42 is a view of the toner bottle unit when view from a side of the toner bottle unit.
Figure 43:
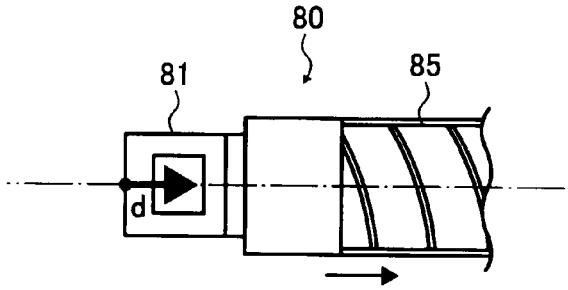
FIG. 43 is a view of the toner bottle unit when view from above the toner bottle unit.
Figure 44:
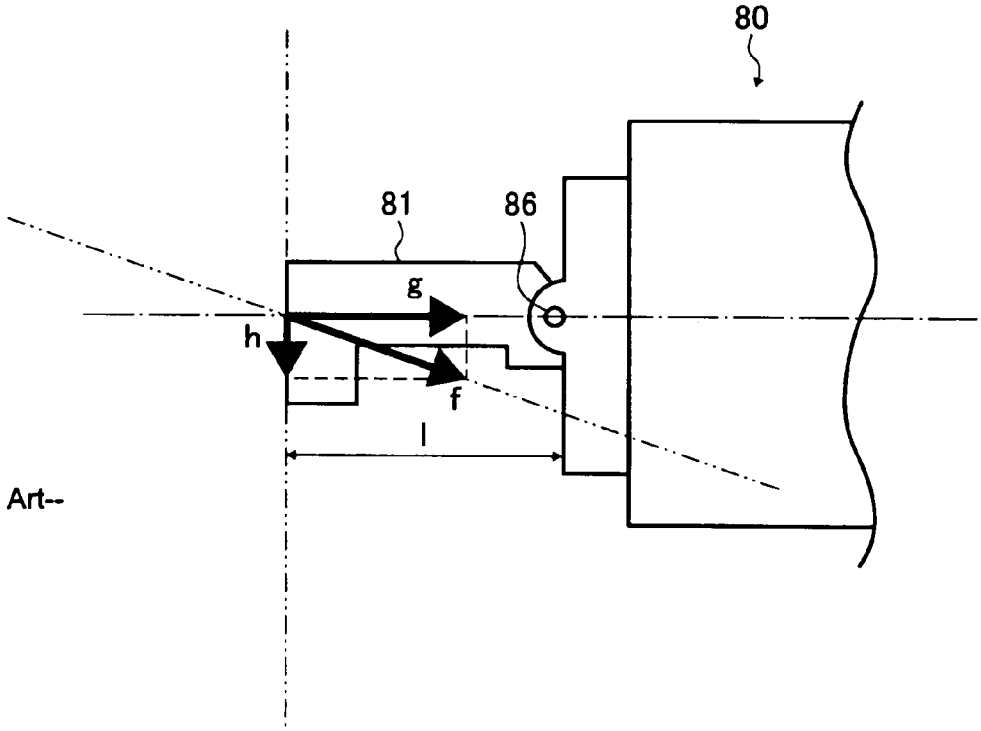
FIG. 44 illustrates a direction of a pushing force applied to an operation lever inclining downward from a longitudinally shaft of the toner bottle.
Figure 45:
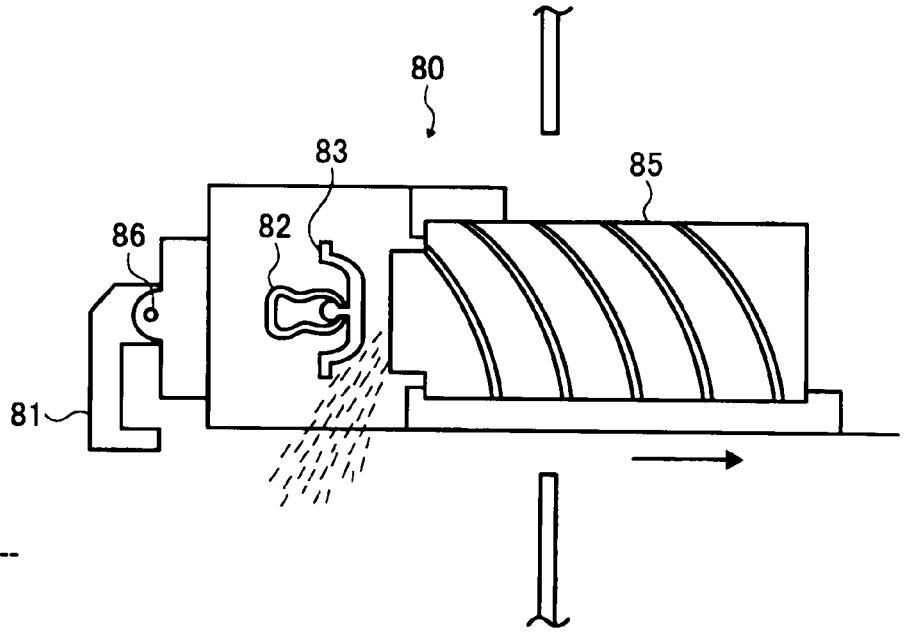
FIG. 45 is a condition when the cap of the toner bottle is removed during when the toner bottle unit is attached to the apparatus body.

Now, an opening and closing operation of a toner conveyance path, which is caused by a shutter mechanism, is described. The up and down movement of the supporting member 52 is created when a portion of the supporting member 52 contacting a surface 54 of the cam member 53 positioned at a prescribed portion of the printer body moves on the cam surface 54 as shown in FIG. 35. The supporting member 52 is located at the lowest position of the cam surface 54, and the penetration hole 62 of the shutter 61 is not communicated with the toner conveyance path 51, and thus the toner conveyance path is closed. As shown in FIG. 36, the supporting member 52 moves along an inclination of the convex portion 55 of the cam member 53. Since the position on the convex portion 55 is higher than the other position of the cam surface 54 as shown in FIG. 34, the supporting member 52 moves upwardly from the state shown in FIG. 35. In conjunction with the movement, the handle section 65 is rotated in a direction shown by an arrow (I) around the rotational axis of the shutter member 61, and the position of the penetration hole 62 is changed. In FIG. 36, since the toner bottle unit 17 is not completely attached to a prescribed position in the apparatus body, the penetration hole 62 is not completely communicated with the toner conveyance path 51. Whereas, as shown in FIG. 37, the toner bottle unit is completely attached to the prescribed position, and accordingly the supporting member 52 is moved to a peak of the concave portion 55 of the cam member 53, i.e., the highest position of the cam surface 54 of the cam member 53. Thus, the supporting member 52 further upwardly moves than the state as shown in FIG. 36, and the handle 65 is rotated in conjunction therewith around the rotational axis in a direction (I). Thus, the penetration hole 62 of the shutter 61 is completely communicated with the toner conveyance path 51.

As mentioned above, since the shutter mechanism 60 is used in the toner bottle unit 17, the toner conveyance path 51 can be open without a special labor of a user. Further, the shutter mechanism 60 is supposed to be erroneously operated and the toner conveyance path 51 is open during attachment of the toner bottle unit 17 to the apparatus body.

When the toner bottle unit 17 is withdrawn from the apparatus body, reverse operations to the above are executed. As a result, the toner conveyance path 51 can be closed by the shutter mechanism 61 without special labor of the user, and the toner conveyance path 51 can be credibly shifted from the open to close states.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A toner bottle unit detachable to an image forming apparatus and for holding a toner bottle containing toner, said toner bottle unit comprising:

an opening/closing device configured to make an opening of the toner bottle by removing a cap from the opening and configured to close the opening by attaching the cap thereto;

an opening/closing operation device configured to swing from an open position, in which the opening/closing device makes the opening, to a close position, in which the opening/closing device closes the opening;

wherein the opening/closing device is operated to make the opening in conjunction with swinging movement of the opening/closing operation device from the close position to the open position, and closes the opening in conjunction with the movement of the opening/closing device from the open position to the close position;

wherein said opening/closing operation device is arranged at a rear end of the toner bottle unit in an attaching direction substantially on a central axis of the toner bottle, wherein said toner bottle unit is installed into the image forming apparatus when pushed substantially along the central axis through the opening/closing operation device; and wherein said opening/closing operation device is rotated between the open and close positions substantially about the central axis.

2. The toner bottle unit as claimed in claim 1, further comprising a rotation inhibition device configured to inhibit the rotation of the opening/closing operation device.

3. The toner bottle unit as claimed in claim 2, wherein said rotation inhibition device includes:

an engaging member arranged in a body of the image forming apparatus; and an engaged member arranged on the opening/closing operation device and configured to be engaged with the engaging member;

wherein said rotation of the opening/closing operation device is inhibited by the engagement of the engaging and engaged members.

4. An image forming apparatus, comprising:

a toner bottle unit configured to detachably hold a toner bottle; and a supporting member configured to support and freely reciprocate the toner bottle unit between a prescribed withdrawal and attachment positions;

wherein said toner bottle unit includes the toner bottle unit as claimed in claim 3.

5. The image forming apparatus as claimed in claim 4, wherein said engaging and engaged members are disengaged with each other when the toner bottle unit is attached to a prescribed attachment position and the supporting member contacts the engaging member.

6. The image forming apparatus as claimed in claim 5, wherein said engaging member has elasticity;

wherein said engaging and engaged members are disengaged with each other by elastic deformation of engaging member when toner bottle unit is attached to the prescribed attachment position; and wherein said engagement is created when toner bottle unit is detached from the prescribed attachment position by a restoration force of the engaging member returning to an original shape.

7. The image forming apparatus as claimed in claim 4, further comprising a movement limitation member configured to limit movement of the toner bottle unit in an attaching and detaching direction;

wherein said engaging and engaged members are disengaged with each other when the toner bottle unit is attached to a prescribed attachment position and the movement limitation member contacts the engaging member.

8. An image forming apparatus, comprising:

a toner bottle unit configured to detachably hold a toner bottle; and a supporting member configured to support and freely reciprocate the toner bottle unit between a prescribed withdrawal and attachment positions;

wherein said toner bottle unit includes the toner bottle unit as claimed in claim 1.

9. The image forming apparatus as claimed in claim 8, further comprising:

a fitting section arranged in the image forming apparatus body; and a fit section arranged on the opening/closing operation device; and wherein said fitting section fits into the fit section when the toner bottle unit is attached to the prescribed attachment position and the opening/closing operation device is displaced to a position other than the open position.

* * * * *